US009899014B2

(12) United States Patent
Nishimura

(10) Patent No.: US 9,899,014 B2
(45) Date of Patent: Feb. 20, 2018

(54) KEYBOARD DEVICE AND KEYBOARD INSTRUMENT

(71) Applicant: CASIO COMPUTER CO., LTD., Shibuya-ku, Tokyo (JP)

(72) Inventor: Yuichi Nishimura, Saitama (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 28 days.

(21) Appl. No.: 15/091,432

(22) Filed: Apr. 5, 2016

(65) Prior Publication Data

US 2016/0300556 A1 Oct. 13, 2016

(30) Foreign Application Priority Data

Apr. 10, 2015 (JP) ..... 2015-080988
Mar. 24, 2016 (JP) ..... 2016-059459

(51) Int. Cl.

| | |
|---|---|
| ***G10C 3/12*** | (2006.01) |
| ***G10H 1/34*** | (2006.01) |
| ***G10B 3/12*** | (2006.01) |
| ***G10C 3/16*** | (2006.01) |

(52) U.S. Cl.

CPC ..... *G10H 1/346* (2013.01); *G10B 3/12* (2013.01); *G10C 3/16* (2013.01); *G10H 1/344* (2013.01); *G10H 2220/265* (2013.01)

(58) Field of Classification Search

USPC ..... 84/440

See application file for complete search history.

(56) References Cited

U.S. PATENT DOCUMENTS

| | | | | |
|---|---|---|---|---|
| 4,860,630 | A * | 8/1989 | Franz | G10H 1/346 84/439 |
| 6,683,242 | B2 | 1/2004 | Inoue et al. | |
| 6,995,308 | B2 * | 2/2006 | Nishida | G10H 1/346 84/238 |
| 7,126,049 | B2 | 10/2006 | Tanaka | |

(Continued)

FOREIGN PATENT DOCUMENTS

| | | | |
|---|---|---|---|
| JP | 2002258835 | A | 9/2002 |
| JP | 2010266719 | A | 11/2010 |
| WO | 2004114275 | A1 | 12/2004 |

OTHER PUBLICATIONS

Extended European Search Report dated Aug. 16, 2016 in counterpart European Application No. 16164221.0.

*Primary Examiner* — Christopher Uhlir

(74) *Attorney, Agent, or Firm* — Holtz, Holtz & Volek PC

(57) ABSTRACT

A keyboard device includes a plurality of transmission members which are displaced in response to a depression operation on each of a plurality of keys and a plurality of hammer members each of which provides an action load to a depressed key by performing a rotating motion in response to the displacement of a transmission member corresponding to the depressed key. The weight of the transmission member is set in accordance with the formation density of a plurality of ribs formed on a transmission body section. Therefore, the weight of the transmission member set in accordance with the formation density of the ribs can be provided to the key as a static load. As a result of this structure, an initial load on a key can be optimized, and a key depressing force on the key at the time of key depression can be favorably transmitted to the hammer member.

8 Claims, 16 Drawing Sheets

(56) References Cited

U.S. PATENT DOCUMENTS

| | | | | |
|---|---|---|---|---|
| 7,687,693 | B2 * | 3/2010 | Clark | G10C 9/00 84/239 |
| 7,781,652 | B2 | 8/2010 | Clark et al. | |
| 2002/0035913 | A1 * | 3/2002 | Arimori | G10C 3/22 84/423 R |
| 2004/0168562 | A1 * | 9/2004 | Yoshisue | G10C 9/00 84/236 |
| 2005/0028665 | A1 | 2/2005 | Tanaka | |
| 2008/0307942 | A1 | 12/2008 | Clark et al. | |
| 2008/0307943 | A1 | 12/2008 | Clark et al. | |
| 2015/0114202 | A1 * | 4/2015 | Suzuki | G10C 3/18 84/236 |

* cited by examiner

PRIOR ART

KEYBOARD DEVICE AND KEYBOARD INSTRUMENT

CROSS-REFERENCE TO RELATED APPLICATIONS

This application is based upon and claims the benefit of priority from the prior Japanese Patent Applications No. 2015-080988, filed Apr. 10, 2015 and No. 2016-059459, filed Mar. 24, 2016, the entire contents of which are incorporated herein by reference.

BACKGROUND OF THE INVENTION

1. Field of the Invention

The present invention relates to a keyboard device for use in a keyboard instrument such as a piano, and a keyboard instrument including the keyboard device.

2. Description of the Related Art

For example, a keyboard device such as a piano is known which includes a wippen that rotates by a key depression operation, a jack that is driven in response to the rotating motion of the wippen, and a hammer member that is driven by the jack and strikes a string such that these components are provided corresponding to a plurality of keys, as described in Japanese Patent Application Laid-Open (Kokai) Publication No. 2002-258835.

This type of keyboard device is structured such that, when a key is depressed, the wippen is rotated by the depressed key, and the jack incorporated in this wippen is driven by the wippen to press up the hammer member, whereby the hammer member is rotated and strikes the string.

However, in this keyboard device, not only a repetition lever for incorporating the jack in the wippen but also a support rod for supporting this repetition lever on the wippen is required. Therefore, there is a problem in that the number of the components is increased and the structure is complicated. Moreover, in order to acquire an optimum key-touch feel, the weight of the hammer member is required to be adjusted, which makes the structure further complicated.

This key-touch feel is determined by the state of counterforce applied to a key after key depression. FIG. 13 is a graph showing the state of counterforce in a general acoustic piano. The horizontal axis represents elapsed time after key depression, and the vertical axis represents the magnitude of counterforce.

The key-touch feel significantly varies particularly depending on timing when counterforce reaches its peak after key depression (in FIG. 13, time t=b).

Because this timing when the counterforce reaches its peak is determined by various elements regarding the wippen and the hammer member such as their positional relation, structure, weight, and materials, it cannot be adjusted easily.

SUMMARY OF THE INVENTION

The present invention is to provide a keyboard device from which a favorable key touch can be acquired, and a keyboard instrument including this keyboard device.

In accordance with one aspect of the present invention, there is provided a keyboard device comprising: a plurality of keys; and action mechanisms respectively provided corresponding to the plurality of keys, wherein each of the action mechanisms includes a transmission member which is displaced in response to a depression operation on a corresponding key of the plurality of keys, a transmission holding shaft which holds the transmission member, and a hammer member which provides an action load to the corresponding key subjected to the depression operation by being displaced in a direction in response to the displacement of the transmission member corresponding to the key subjected to the depression operation, wherein the transmission member includes a transmission body section, a transmission fitting section formed at one end of the transmission body section and mounted on the transmission holding shaft, and a barycenter position setting member formed on the transmission body section, and wherein the barycenter position setting member is set so that a key touch feeling of the depression operation is adjusted.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 4A and FIG. 4B are diagrams showing portions of a transmission member and a transmission holding member depicted in FIG. 3, of which FIG. 4A is an enlarged planar view thereof and FIG. 4B is an enlarged sectional view of the main portion taken along line B-B in FIG. 4A:

FIG. 6A and FIG. 6B are diagrams showing portions of a hammer member and a hammer holding member depicted in FIG. 3, of which FIG. 6A is an enlarged planar view thereof and FIG. 6B is an enlarged sectional view of the main portion taken along line D-D in FIG. 6A;

FIG. 7A, FIG. 7B, FIG. 7C, and FIG. 7D are diagrams showing the hammer member depicted in FIG. 3, of which FIG. 7A is an enlarged side view of a hammer member for a white key, FIG. 7B is an enlarged planar view thereof, FIG. 7C is an enlarged side view of a hammer member for a black key, and FIG. 7D is an enlarged planar view thereof;

FIG. 8A, FIG. 8B, and FIG. 8C are diagrams showing an interlock control section depicted in FIG. 3, of which FIG. 8A is an enlarged sectional view of the interlock control section taken along line E-E in FIG. 3, FIG. 8B is an enlarged side view of an interlock projecting section of the interlock control section, and FIG. 8C is an exploded and enlarged side view of the interlock projecting section;

FIG. 11A and FIG. 11B are diagrams showing another modification example of the transmission member in the keyboard device to which the present invention has been applied, of which FIG. 11A is an enlarged side view thereof and FIG. 11B is an enlarged sectional view taken along line C-C in FIG. 11A;

FIG. 12A and FIG. 12B are diagrams showing still another modification example of the transmission member in the keyboard device to which the present invention has been applied, of which FIG. 12A is an enlarged side view thereof and FIG. 12B is an enlarged sectional view taken along line C-C in FIG. 12A;

DETAILED DESCRIPTION OF THE PREFERRED EMBODIMENT

Hereafter, an embodiment in which the present invention has been applied in an electronic keyboard instrument is described with reference to FIG. 1 to FIG. 9.

Figure 1:
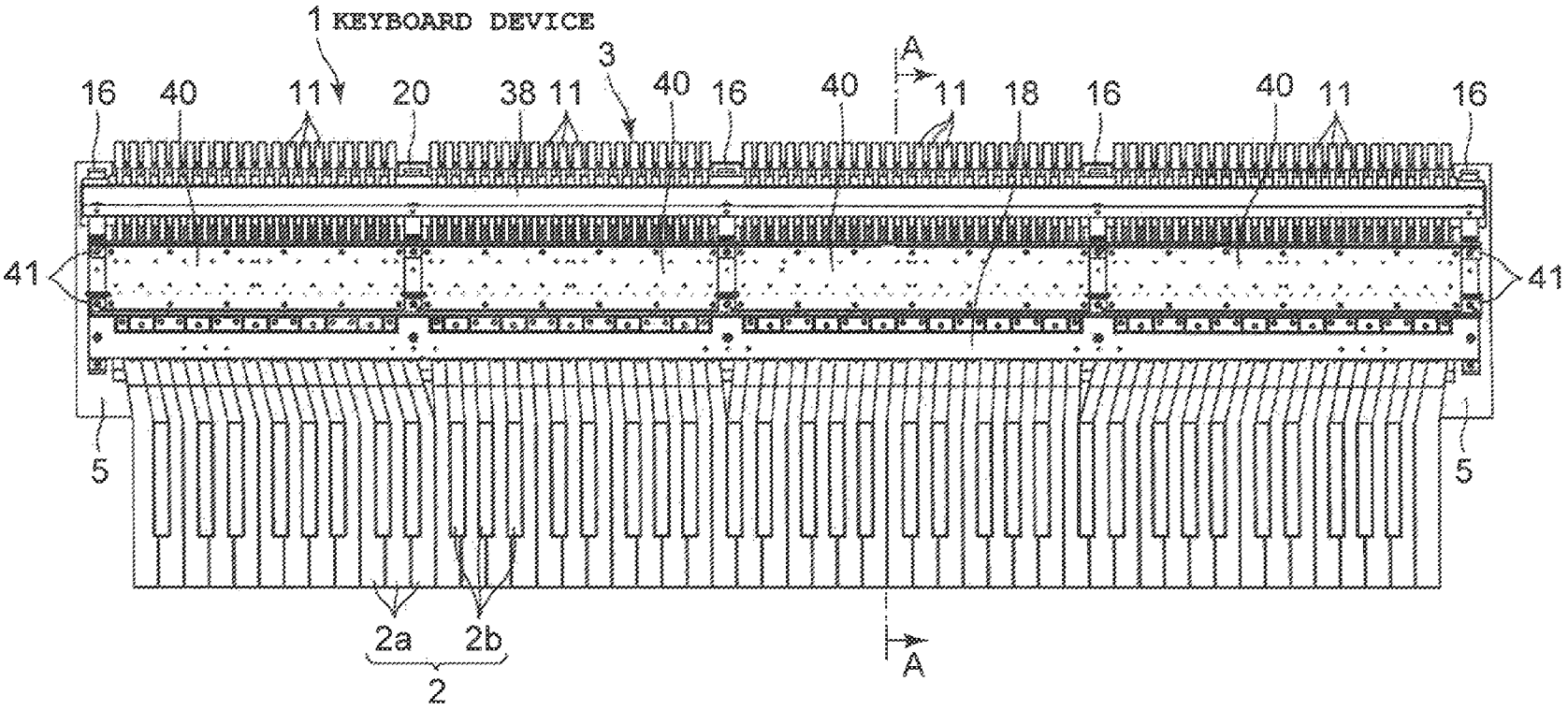
FIG. 1 is a planar view of a keyboard device in an embodiment where the present invention has been applied in an electronic keyboard instrument.
Figure 2:
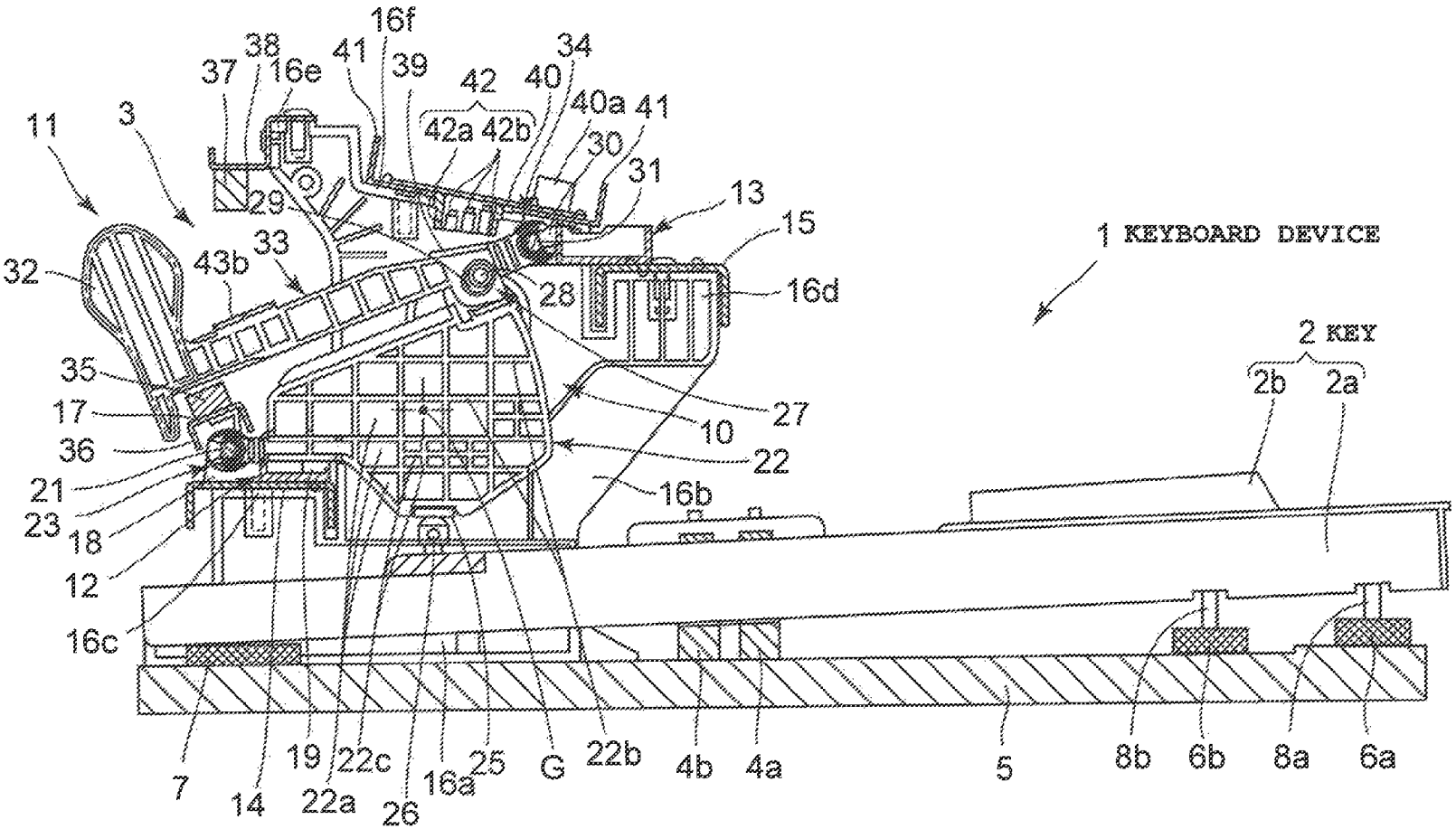
FIG. 2 is an enlarged sectional view of the keyboard device taken along line A-A in FIG. 1.

The electronic keyboard instrument includes a keyboard device 1 as depicted in FIG. 1 and FIG. 2. This keyboard device 1, which is mounted inside an instrument case (not depicted), includes a plurality of keys 2 arranged in parallel and action mechanisms 3 each of which provides an action load to a corresponding key 2 of the plurality of keys 2 in response to a key depression operation.

The plurality of keys 2 have white keys 2*a* and black keys 2*b* as depicted in FIG. 1 and FIG. 2. These white keys 2*a* and black keys 2*b*, eighty eight in total, are arranged in parallel. Each of the plurality of keys 2 is supported by balance pins 4*a* and 4*b* at a substantially intermediate portion in the front and rear direction (in FIG. 2, the lateral direction) of the key so as to be rotatable in the vertical direction and, in this state, these keys 2 are arranged in parallel on a base plate 5. That is, the white keys 2*a* and the black keys 2*b* have different lengths in the front and rear direction, and the lengths of the white keys 2*a* are longer than the lengths of the black keys 2*b*.

In addition, on the base plate 5, cushion members 6*a* and 6*b* with which the lower surface of the front end portion (in FIG. 2, the right end portion) of each key 2 separably comes in contact are provided along the array direction of the keys 2, as depicted in FIG. 2. Also, on the base plate 5, a cushion member 7 with which the lower surface of the rear end portion (in FIG. 2, a left end portion) of each key 2 separably comes in contact is provided along the array direction of the keys 2.

As a result, for the plurality of keys 2, each key stroke is set by the cushion members 6*a* and 6*b* on the front side and the cushion member 7 on the rear side, as depicted in FIG. 2. Moreover, on the base plate 5, guide pins 8*a* and 8*b* for preventing the rolling of the plurality of keys 2 in their array direction are provided upright.

Figure 3:
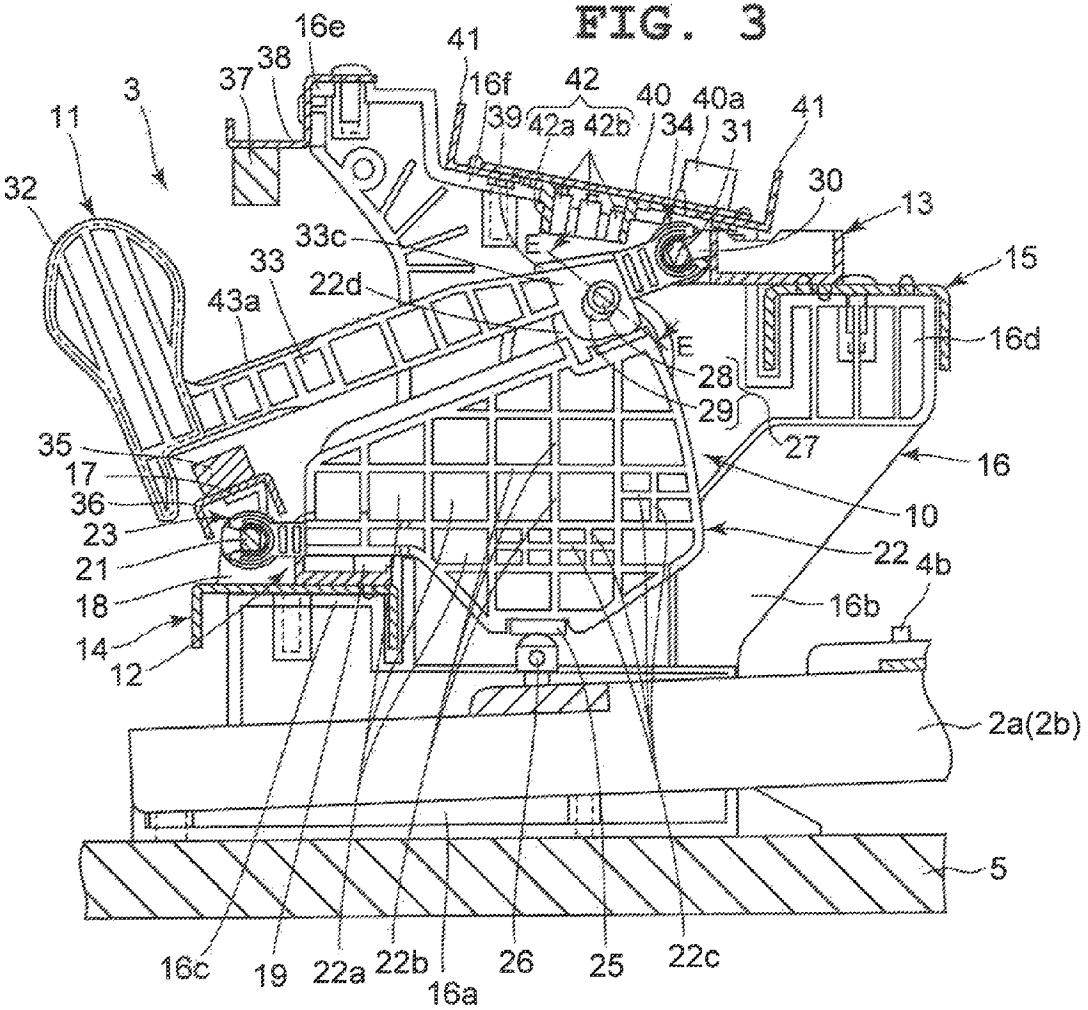
FIG. 3 is an enlarged sectional view of the main portion of the keyboard device depicted in FIG. 2.

The action mechanisms 3 include a plurality of transmission members 10 each of which rotates in the vertical direction in response to a key depression operation on a corresponding one of the plurality of keys 2, and a plurality of hammer members 11 each of which rotates in the vertical direction in accordance with the rotating motion of a corresponding one of the plurality of transmission members 10 and thereby provides an action load to the corresponding one of the plurality of keys 2, as depicted in FIG. 1 to FIG. 3. In this embodiment, the plurality of keys 2 are each structured to be rotated in the counterclockwise direction around the balance pins 4*a* and 4*b* by the weight of a corresponding one of the plurality of transmission members 10 and the weight of a corresponding one of the plurality of hammer members 11, and pressed up to an initial position, so that an initial load is provided thereto.

These action mechanisms 3 also include a plurality of transmission holding members 12 each of which rotatably holds a corresponding one of the plurality of transmission members 10 and a plurality of hammer holding members 13 each of which rotatably holds a corresponding one of the plurality of hammer members 11, as depicted in FIG. 2 and FIG. 3. The plurality of transmission holding members 12 are mounted on a transmission support rail 14 arranged along the array direction of the keys 2. Also, the plurality of hammer holding members 13 are mounted on a hammer support rail 15 arranged along the array direction of the keys 2. These transmission support rail 14 and hammer support rail 15 are supported by a plurality of support members 16 and arranged above the plurality of keys 2.

The plurality of support members 16 are mounted upright on the base plate 5 and positioned in a plurality of areas defined in advance over the entire length of the keys 2 in the arrangement direction. Here, the number of the arranged keys 2 is, for example, eighty eight in total. Accordingly, the plurality of support members 16 are arranged at both ends of the plurality of keys 2 in the array direction and three areas located at every twenty keys. That is, in the present embodiment, the plurality of support members 16 is arranged in five areas over the entire length of the keys 2 in the array direction.

The support members 16 are made of hard synthetic resin such as ABS (Acrylonitrile Butadiene Styrene) resin, and each of them has a mount section 16*a* mounted on the base plate 5 and a bridge section 16*b* integrally formed on the mount section 16*a*, as depicted in FIG. 2 and FIG. 3. By the support member mount section 16*a* being mounted on the base plate 5, the support member 16 is structured to be arranged between rear portions of the plurality of keys 2 with the bridge section 16*b* projecting above the key 2.

Here, a lower portion of the rear end of the bridge section 16*b*, that is, an upper portion on the rear side (in FIG. 2, an upper portion on the left) of the mount section 16*a* is provided with a rear-side rail support section 16*c* which supports the transmission support rail 14, as depicted in FIG. 2 and FIG. 3. Also, an upper portion on the front side (in FIG. 2, an upper portion on the right) of the bridge section 16*b* is provided with a front-side rail support section 16*d* which supports the hammer support rail 15. Moreover, an upper portion on the rear side (in FIG. 2, an upper portion on the left) of the bridge section 16*b* is provided with a stopper rail support section 16*e*, and an upper portion of the bridge section 16*b* is provided with a substrate rail support section 16*f*.

The transmission support rail 14 has a shape formed by both side portions of a band plate being folded downward along the longitudinal direction, and has a length corresponding to the entire length of the plurality of keys 2 in the array direction, as depicted in FIG. 2 and FIG. 3. The transmission support rail 14 is structured such that predetermined portions thereof in the array direction of the keys 2 are mounted on the rear-side rail support sections 16*c* of the plurality of support members 16.

On the transmission support rail 14, the plurality of transmission holding members 12 and a plurality of stopper support sections 17 are mounted along the array direction of the keys 2, as depicted in FIG. 2 and FIG. 3. Here, the plurality of stopper support sections 17 are made of metal plates, and are mounted in five areas on the transmission support rail 14 corresponding to the plurality of support members 16 with them projecting above the plurality of transmission holding members 12.

Figure 4A:
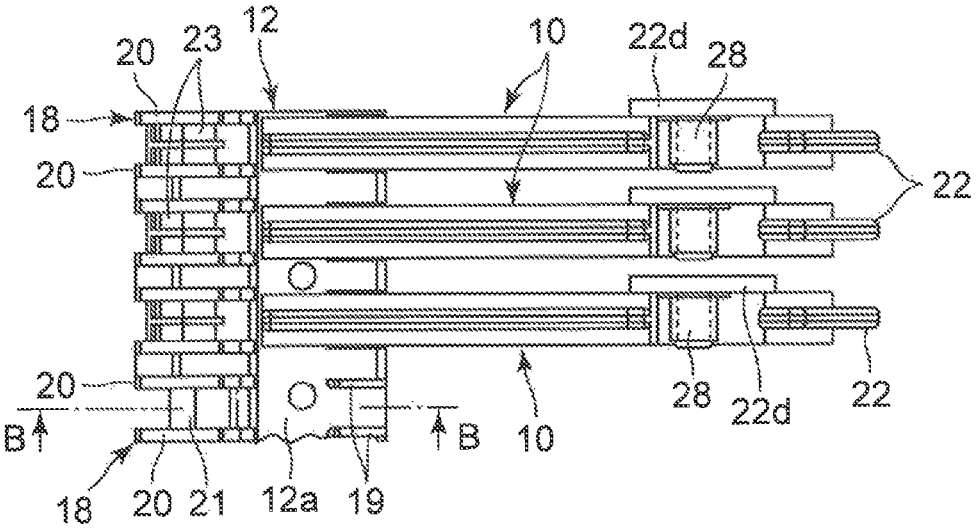
Figure 4B:
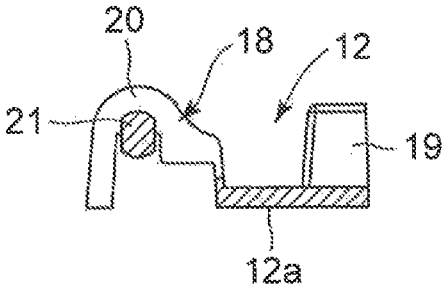

The transmission holding members 12 are made of hard synthetic resin such as ABS resin, and are integrally formed along the array direction of the keys 2 with a plurality of shaft support sections 18 on a body plate 12*a* respectively opposing, for example, ten keys 2, as depicted in FIG. 4A and FIG. 4B. The shaft support sections 18 are each structured to have the transmission member 10 rotatably mounted thereon so as to prevent the rolling of the transmission member 10.

That is, the shaft support section 18 has a pair of guide walls 20 and a transmission holding shaft 21 formed between the pair of guide walls 20, as depicted in FIG. 4A and FIG. 4B. The pair of guide walls 20 is formed corresponding to each of the plurality of transmission members 10 at a rear end portion (in FIG. 4A, a left end portion) on the body plate 12*a* of the transmission holding member 12.

This pair of guide walls 20 constitutes a guide section which rotatably guides the transmission fitting section 23 of the transmission member 10 with a later-described transmission fitting section 23 of the transmission member 10 being slidably interposed therebetween, as depicted in FIG. 4A. The transmission holding shaft 21 is formed in a substantially round-bar shape with the sides of its outer peripheral surface being cut off, and therefore has a non-circular shape in cross section, as depicted in FIG. 4B.

Also, the transmission holding member 12 has a regulating section 19 which regulates the rolling of the transmission member 10 when the keyboard device is packaged and transported, as depicted in FIG. 2 to FIG. 4B. The regulating section 19 includes a pair of regulating walls formed corresponding to each transmission member 10 on a front portion (in FIG. 4A, a right side portion) of the body plate 12*a* of the transmission holding member 12. This regulating section 19 rotatably guides the transmission member 10 with a lower portion on the rear side of the transmission member 10 being interposed therebetween, and also regulates the rolling of the transmission member 10 when the keyboard device is packaged and transported.

The transmission members 10 are made of hard synthetic resin such as ABS resin, and each of which has a transmission body section 22 that rotates in the vertical direction in response to a depression operation on a corresponding key 2 and thereby rotates the hammer member 11 in the vertical direction, and the transmission fitting section 23 integrally formed with the transmission body section 22 and rotatably mounted on the transmission holding shaft 21 of the transmission holding member 12, as depicted in FIG. 2 to FIG. 5B.

Figure 5A:
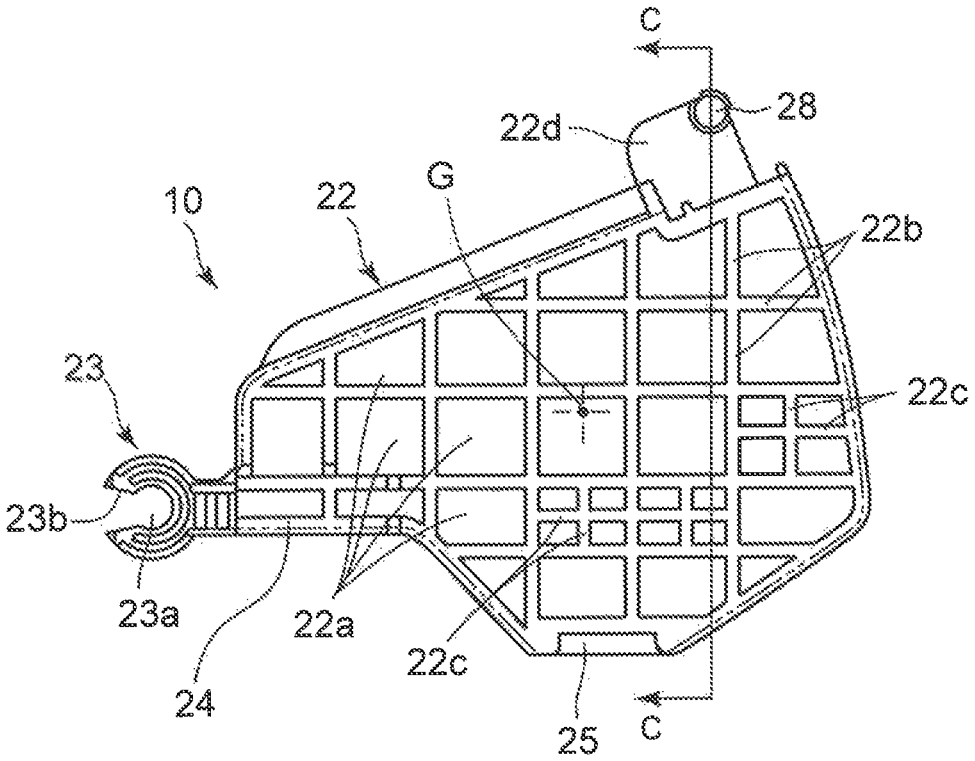
FIG. 5A is an enlarged side view of the transmission member depicted in FIG. 3.
Figure 5B:
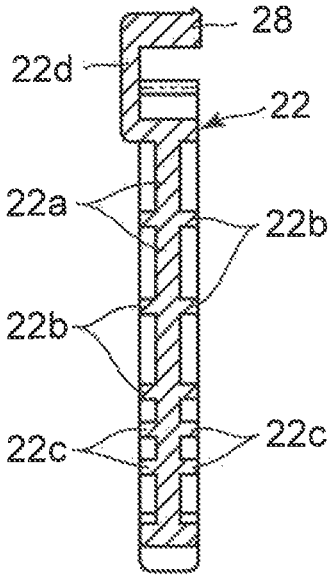
FIG. 5B is an enlarged sectional view thereof taken along line C-C in FIG. 5A.

The transmission body section 22 is formed in a substantially waffle shape, as depicted in FIG. 2, FIG. 3, and FIG. 5A. That is, the transmission body section 22 has a thin vertical plate section 22*a* and a plurality of rib sections 22*b* formed in a substantially lattice shape on an outer peripheral portion and both side surfaces of the vertical plate section 22*a*, which are formed in a waffle shape, as depicted in FIG. 5A and FIG. 5B. Here, the transmission body section 22 is structured such that the weight and barycenter position of the transmission member 10 are adjusted by the shape and thickness of the vertical plate section 22*a* and the formation density of the plurality of rib sections 22*b*.

For example, the plurality of rib sections 22*b* is provided in a substantially lattice shape on both side surfaces of the vertical plate section 22*a*, as depicted in FIG. 5A and FIG. 5B. In this lattice shape, a plurality of finer-grid rib sections 22*c* is provided to part of cells in the lattice as a barycenter position setting member of the present invention, and therefore the number of ribs formed in the part of the cells is increased. That is, these fine-grid rib sections 22*c* are provided in two cells positioned on the lower side of the center of the vertical plate 22*a* and in a cell positioned at a distance from the transmission fitting section 23 longer than a distance from the center of the vertical plate section 22*a*.

As a result, the weight of the transmission member 10 is set by the shape and thickness of the vertical plate section 22*a* of the transmission body section 22 and the formation density of the plurality of rib sections 22*b* and 22*c*, as depicted in FIG. 5A. Also, in the transmission member 10, by the formation state of the plurality of rib sections 22*b* and 22*c*, that is, the formation positions of the plurality of fine-grid rib sections 22*c* provided to part of the plurality of rib sections 22*b*, a barycenter position G of the transmission member 10 is set at a position shifted from the center of the transmission body section 22.

Figure 13:
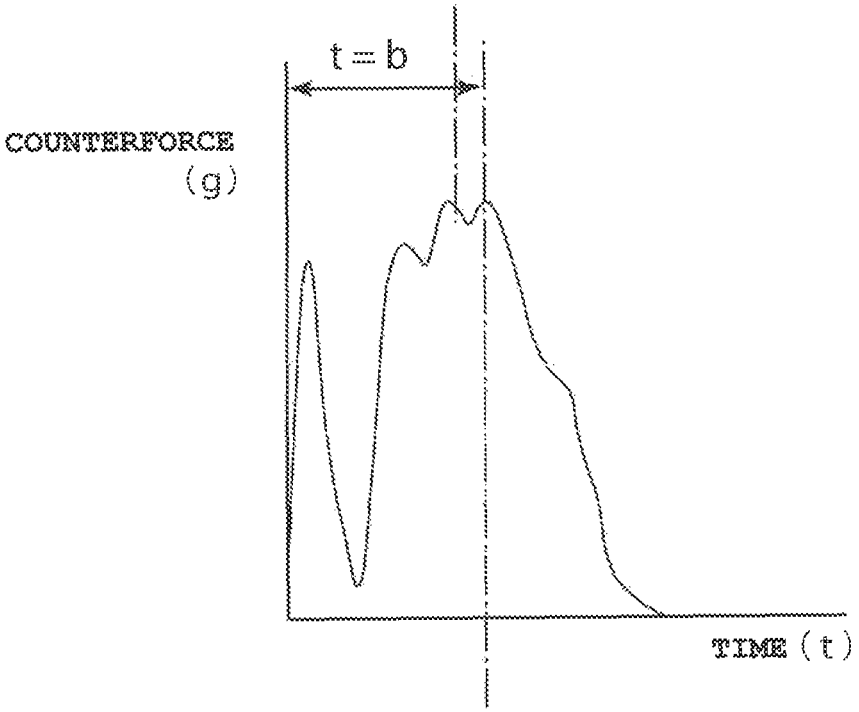
FIG. 13 is a graph showing the state of counterforce in a general acoustic piano.

The distance between the barycenter position G and the center position of the transmission fitting section 23 is related to the counterforce characteristic depicted in the graph of FIG. 13.

FIG. 14A to FIG. 16B are diagrams showing a relation between the barycenter position of the transmission member 10 and the counterforce characteristic.

Figure 14A:
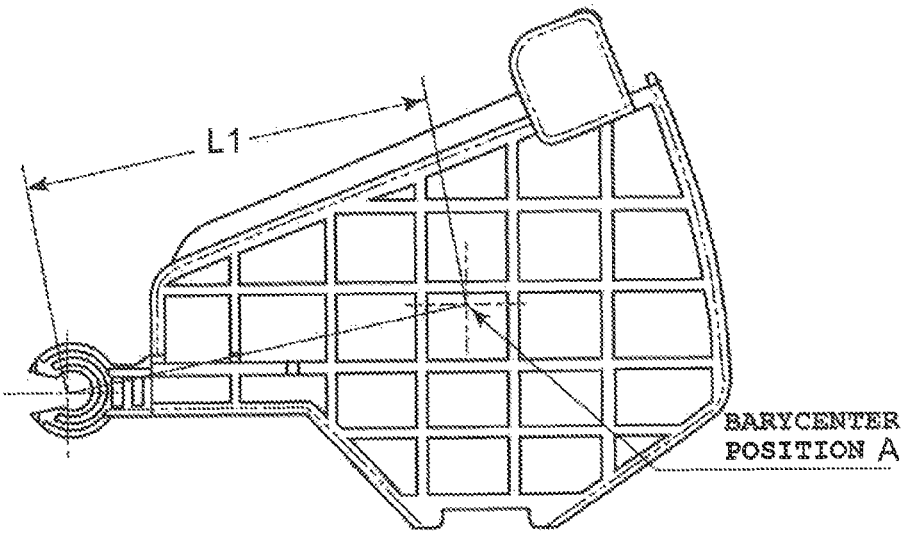
FIG. 14A is a diagram showing a transmission member without a fine-grid rib section.
Figure 14B:
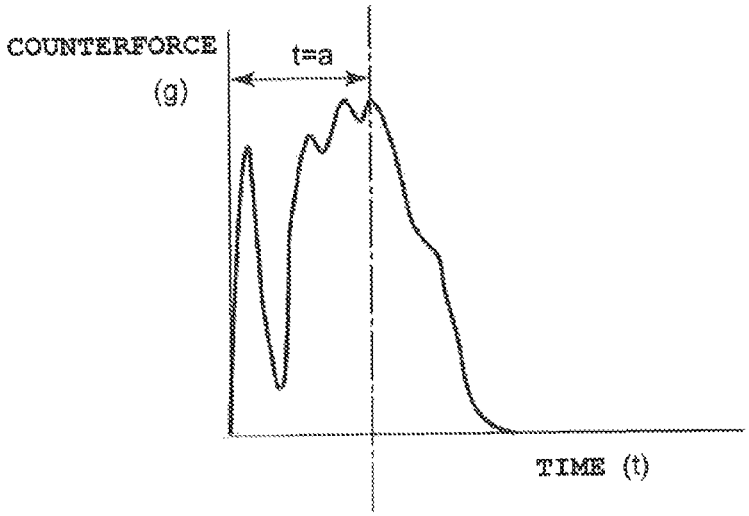
FIG. 14B is a diagram showing the characteristic of counterforce applied to a key when the key is depressed by using this transmission member.

FIG. 14A is a diagram showing a case in which the finer-grid rib sections 22*c* having a lattice shape are not provided as compared with the transmission member 10 depicted in FIG. 5A, and a distance between a barycenter position A and the center position of the transmission fitting section 23 is L1. The counterforce characteristic is as depicted in FIG. 14B, and the timing when the counterforce reaches its peak comes after time "a" has elapsed after a key depression operation.

Figure 15A:
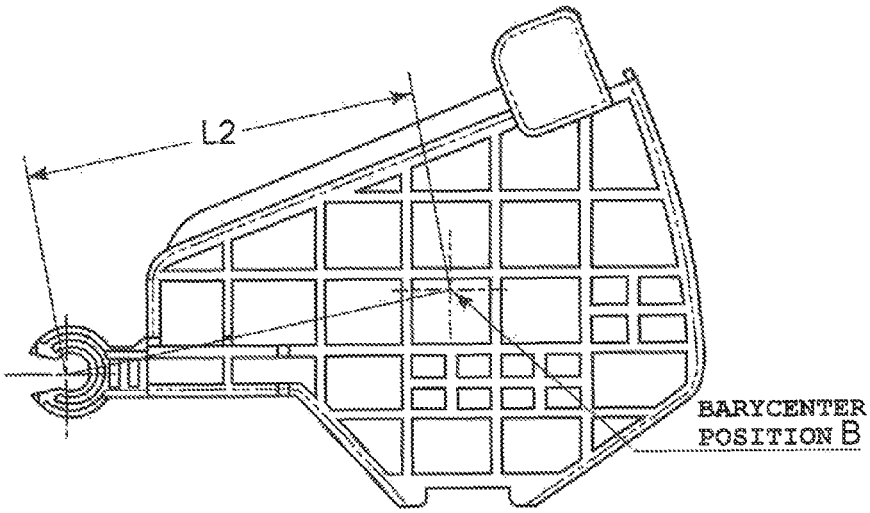
FIG. 15A is a diagram showing a case in which, as the transmission member depicted in FIG. 5A, ribs are provided in two cells positioned on the lower side and a cell positioned at a distance from a transmission fitting section longer than a distance from the center of the transmission member.
Figure 15B:
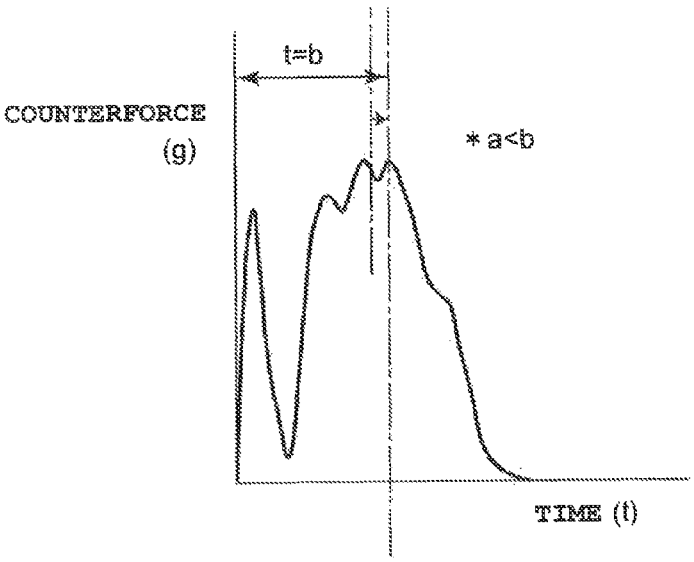
FIG. 15B is a diagram showing the characteristic of counterforce applied to a key when the key is depressed by using this transmission member.

By contrast, FIG. 15A is a diagram showing a case in which, as with the transmission member 10 depicted in FIG. 5A, the rib sections 22*c* are provided in two cells positioned on the lower side of the center of the transmission member 10 and a cell positioned at a distance from the transmission fitting section 23 longer than the distance from the center. In this case, the barycenter position is changed to a barycenter position B, and a distance L2 between the barycenter position B and the center position of the transmission fitting section 23 is longer than the distance L1. As a result, when the transmission member 10 is rotated by key depression, the distance of the barycenter position B from the center position of the transmission fitting section 23, which is a pivot point of rotation, is longer than that in the case of FIG. 14A. Therefore, the moment of inertia is increased, and the timing (time b) when the counterforce reaches its peak can be delayed as compared with the case of FIG. 14A (b>a). In the present embodiment, by setting this time "b" equal to that in the characteristic of the acoustic piano in FIG. 13, a key touch feel identical to that of the acoustic piano can be acquired.

Figure 16A:
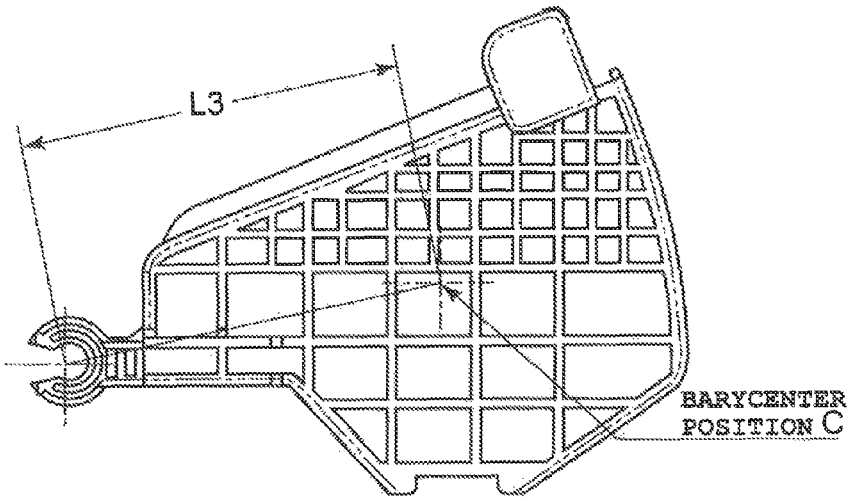
FIG. 16A is a diagram showing a structure in which rib sections are provided on the lower side of the transmission member 10 having a large-grid lattice shape and the number of ribs formed on the upper side thereof is increased to form a small-grid lattice shape.
Figure 16B:
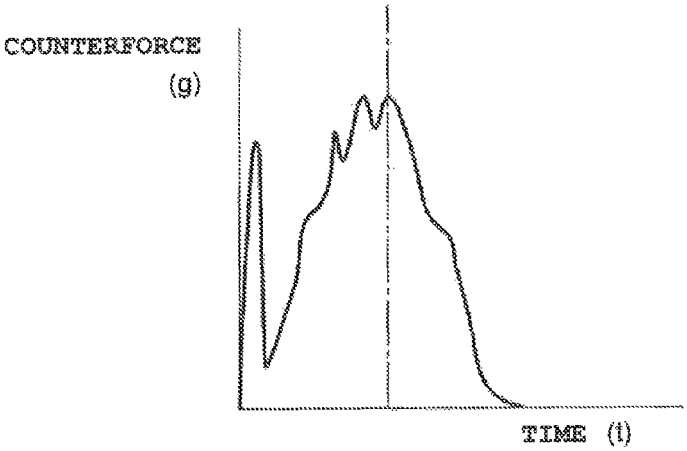
FIG. 16B is a diagram showing the characteristic of counterforce applied to a key when the key is depressed by using this transmission member.

FIG. 16A is a diagram showing a structure in which rib sections are formed on the lower side of the transmission member 10 in a large-grid lattice shape and the number of ribs formed on the upper side thereof is increased to form a small-grid lattice shape. A distance L3 between a barycenter position C and the center position of the transmission fitting section 23 in this case is longer than the distances L1 and L2. As a result, when the transmission member 10 is rotated by key depression, the moment of inertia is further increased as compared with the cases of FIG. 14A and FIG. 15A, and the timing (time c) when the counterforce reaches its peak can be further delayed as compared with the cases of FIG. 14A and FIG. 15A (c>b>a).

As described above, in the present embodiment, the barycenter position of the transmission member 10 can be changed in accordance with the number of ribs formed on the transmission member 10 and the positions of the ribs formed thereon. As a result of this structure, the characteristic of counterforce applied to a key by key depression can be changed, and a more favorable key-touch feel can be acquired.

Also, in the transmission member 10, the rigidity is ensured by the plurality of rib sections 22*b* and 22*c* even though the thickness of the vertical plate section 22*a* of the transmission body section 22 is thinly formed. In addition, the transmission member 10 is structured such that, when it is to be formed of synthetic resin, the occurrence of a shrink is prevented by the plurality of rib sections 22*b* and 22*c*.

The transmission fitting section 23 is formed in an inverted C shape as a whole, and projects rearward at a rear end portion of the transmission body section 22, as depicted in FIG. 2. FIG. 3, and FIG. 5A. That is, the transmission fitting section 23 is formed having a thickness in the array direction of the keys 2 substantially equal to a length between the paired guide walls 20 of the shaft support section 18, and slidably inserted between the paired guide walls 20, as depicted in FIG. 4A.

Also, the transmission fitting section 23 is structured to have a fitting hole 23*a* provided in the center thereof, in which the transmission holding shaft 21 of the transmission holding member 12 fits, as depicted in FIG. 5A. At a portion around fitting hole 23*a*, that is, at a rear portion around the fitting hole 23*a*, an insertion port 23*b* is formed into which the transmission holding shaft 21 is removably inserted. By the transmission holding shaft 21 being inserted into the fitting hole 23*a* through the insertion port 23*b*, the transmission fitting section 23 is rotatably mounted on the transmission holding shaft 21.

Here, the transmission fitting section 23 is structured such that, when the transmission holding shaft 21 is to be inserted into the fitting hole 23*a* through the insertion port 23*b*, the transmission fitting section 23 stands the transmission member 10 upright above the transmission holding shaft 21 so that the insertion port 23*b* corresponds to a portion of the transmission holding shaft 21 where both sides have been cut off, and then the insertion port 23*b* is slightly widened by the transmission holding shaft 21 when the transmission holding shaft 21 is pressed into the insertion port 23*b*, whereby the transmission holding shaft 21 is inserted and fitted into the fitting hole 23*a*, as depicted in FIG. 5A.

At a lower portion on the rear side of the transmission body section 22 of the transmission member 10, a thin engaging section 24 that is regulated by the regulating section 19 of the transmission holding member 12 is provided, as depicted in FIG. 2, FIG. 3, and FIG. 5A. The side surfaces of this engaging section 24 at the lower portion on the rear side of the transmission body section 22 have been cut off, as depicted in FIG. 5A.

Accordingly, the engaging section 24 has a thickness substantially equal to a length between the pair of regulating walls of the regulating section 19, as depicted in FIG. 5A. As a result, the engaging section 24 is structured to rotatably guide the transmission member 10 by being inserted between the pair of regulating walls of the regulating section 19 and also regulate the rolling of the transmission member 10 when the keyboard device is packaged and transported.

Also, the transmission body section 22 of the transmission member 10 is formed such that its lower portion projects toward the upper surface of the key 2, as depicted in FIG. 2, FIG. 3, FIG. 4A, and FIG. 5A. At a lower end portion of the transmission body section 22, a transmission felt 25 is provided. The transmission felt 25 is structured to allow a capstan 26 provided on an upper portion on the rear side of the key 2 to come in contact with the transmission felt 25 from below.

As a result, the transmission member 10 is structured to be pressed up by the capstan 26 of the key 2 coming in contact with the transmission felt 25 from below when the key 2 is depressed, and thereby rotate around the transmission holding shaft 21 in the counterclockwise direction, as depicted in FIG. 2 and FIG. 3. Also, the transmission body section 22 of the transmission member 10 is formed such that its upper portion at the front end is higher than its upper portion at the rear end, so that its upper side portion is slanted downward to the rear portion (in FIG. 2, downward to the left).

On an upper portion at the front end of the transmission body section 22, a support section 22*d* is provided projecting upward, as depicted in FIG. 2, FIG. 5A, and FIG. 5B. That is, the support section 22*c* is structured to move in the vertical direction along a side surface of the hammer member 11 described below without coming in contact with the hammer member 11. Also, on a side surface of the support section 22*c*, an interlock projecting section 28 of an interlock control section 27 described below is provided.

On the other hand, as with the transmission support rail 14, the hammer support rail 15 has a shape where both side portions of a band plate have been folded downward along the longitudinal direction and has a length corresponding to the entire length of the plurality of keys 2 in the array direction, as depicted in FIG. 1 to FIG. 3. This hammer support rail 15 is structured such that predetermined portions thereof in the array direction of the keys 2 are mounted on the front-side rail support sections 16*d* of the plurality of support members 16. On the hammer support rail 15, the plurality of hammer holding members 13 are mounted along the array direction of the keys 2.

Figure 6A:
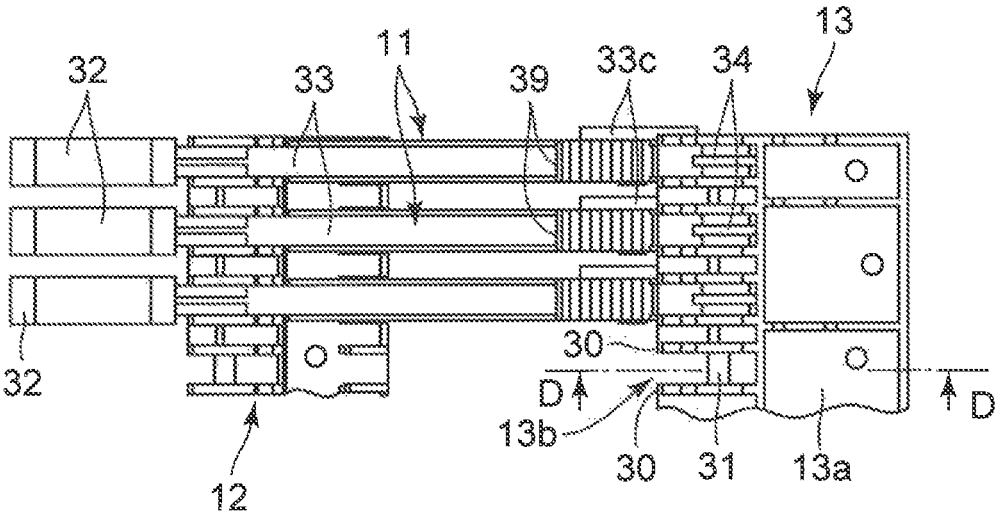
Figure 6B:
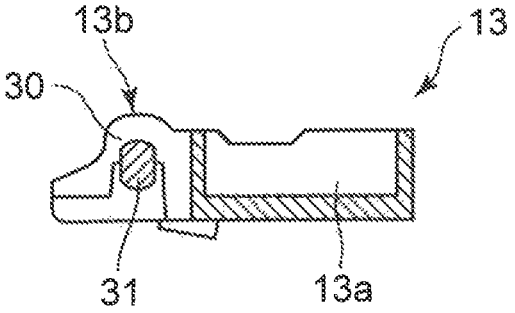

These hammer holding members 13 are made of hard synthetic resin such as ABS resin, and integrally formed along the array direction of the keys 2 with a shaft support section 13*b* being provided to a lower end portion of a rail-shaped body plate 13*a* whose upper portion is open and being opposed to each of, for example, ten keys 2, as depicted in FIG. 6A and FIG. 6B. The shaft support sections 13*b* are each structured to have the hammer member 11 rotatably mounted thereon so as to prevent the rolling of the hammer member 11.

That is, the shaft support section 13*b* has a pair of guide walls 30 and a hammer holding shaft 31 formed between the paired guide walls 30, as depicted in FIG. 2, FIG. 3, FIG. 6A, and FIG. 6B. This pair of guide walls 30 is formed on a rear end portion (in FIG. 6B, a left end portion) of the body plate 13*a*, corresponding to each of the plurality of hammer members 11.

Also, this pair of guide walls 30 constitutes a guide section that rotatably guides the hammer fitting section 34 of the hammer member 11 with a hammer fitting section 34 of the hammer member 11 being interposed therebetween, as depicted in FIG. 6A and FIG. 6B. The hammer holding shaft 31 is formed in a substantially round-bar shape with both sides of its outer peripheral surface being cut off as with the transmission holding shaft 21, and therefore has a non-circular shape in cross section, as depicted in FIG. 6B.

The hammer member 11 is made of hard synthetic resin such as ABS resin, and has a hammer section 32 and a hammer arm 33, which are formed integrally, as depicted in FIG. 6A, FIG. 7A, FIG. 7B, FIG. 7C and FIG. 7D. Here, the structure of the hammer member 11 for each white key 2*a* of the keys 2 and the structure of the hammer member 11 for each black key 2*b* are partially different, as depicted in FIG. 7A to FIG. 7D. That is, their stopper contact sections 43*a* and 43*b* described later, each of which comes in contact with an upper-limit stopper 37, are different from each other.

The hammer section 32 is structured to have a scoop-shaped vertical plate section 32*a* and a plurality of rib sections 32*b* formed on its outer peripheral portion and both side surfaces, as depicted in FIG. 6A, FIG. 7A, FIG. 7B, FIG. 7C and FIG. 7D. This hammer section 32 is structured such that the weight of the hammer member 11 is adjusted by the shape of the scoop-shaped vertical plate section 32*a* and the formation density of the plurality of rib sections 32*b*.

The hammer arm 33 is structured to have a lateral plate section 33*a* whose length in the front and rear direction is substantially equal to that of the transmission member 10 and rib sections 33*b* formed on its outer peripheral portion and both side surfaces, as depicted in FIG. 7A to FIG. 7D. At a front end portion (in FIG. 7A to FIG. 7D, a right end portion) of the hammer arm 33, the hammer fitting section 34 is formed, which is rotatably mounted on a hammer holding member 13.

As with the transmission fitting section 23, the hammer fitting section 34 is formed in an inverted C shape as a whole, and projects frontward at a front end portion of the hammer arm 33, as depicted in FIG. 7A to FIG. 7D. The hammer fitting section 34 is formed such that its thickness in the array direction of the keys 2 is substantially equal to a length between the paired guide walls 30, and slidably inserted between the paired guide walls 30, as depicted in FIG. 6A.

Figure 7A:
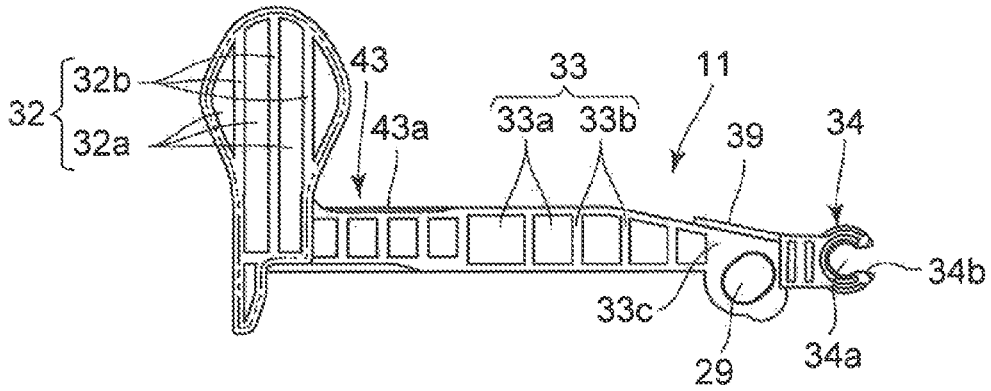
Figure 7B:
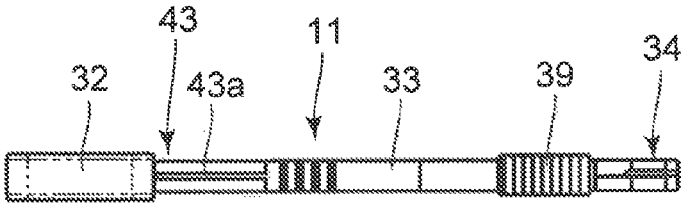
Figure 7C:
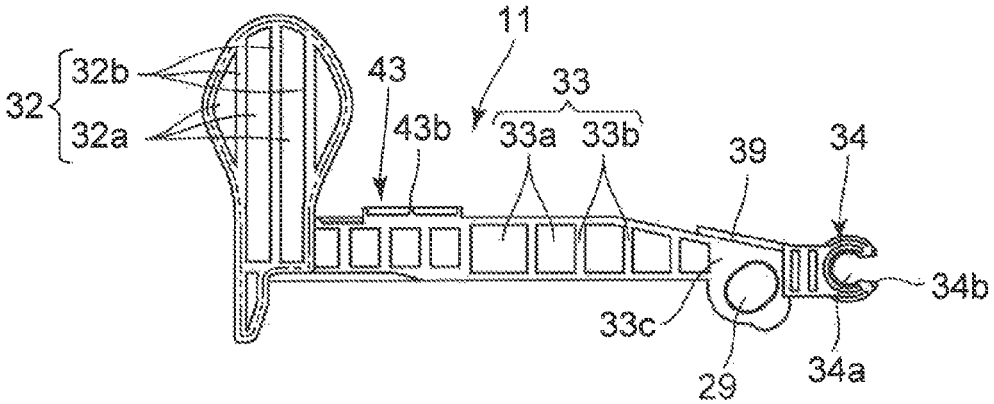
Figure 7D:
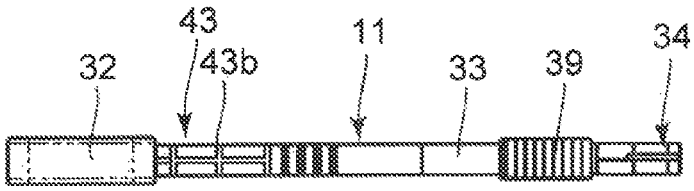

Also, the hammer fitting section 34 is structured to have a fitting hole 34*a* provided in its center as depicted in FIG. 7A and FIG. 7C, into which the hammer holding shaft 31 of the hammer holding member 13 is fitted. At a portion around the fitting hole 34*a*, that is, at a front portion around the fitting hole 34*a*, an insertion port 34*b* is formed into which the hammer holding shaft 31 is removably inserted. By the hammer holding shaft 31 being inserted into the fitting hole 34*a* through the insertion port 34*b*, the hammer fitting section 34 is rotatably mounted on the hammer holding shaft 31.

Here, the hammer fitting section 34 is structured such that, when the hammer holding shaft 31 is to be inserted into the fitting hole 34*a* through the insertion port 34*b*, the hammer fitting section 34 slants the hammer holding member 13 downward to the rear (in FIG. 7A and FIG. 7B, to the right) so that the insertion port 34*b* corresponds to a portion of the hammer holding shaft 31 where both sides have been cut off, and then the insertion port 34*b* is slightly widened by the hammer holding shaft 31 when the hammer holding shaft 31 is pressed into the insertion port 34*b*, whereby the hammer holding shaft 31 is inserted and fitted into the fitting hole 34*a*, as depicted in FIG. 7A and FIG. 7B.

That is, the hammer holding member 13 is structured such that, because it has been coupled to the transmission member 10 by the interlock control section 27 as depicted in FIG. 3 before the hammer member 11 is mounted, it is slanted downward to the rear so that the insertion port 34*b* of the hammer fitting section 34 corresponds to the hammer holding shaft 31 in FIG. 7, and then the hammer holding shaft 31 is mounted on the hammer support rail 15 after being inserted and fitted into the fitting hole 34*a*.

Figure 8A:
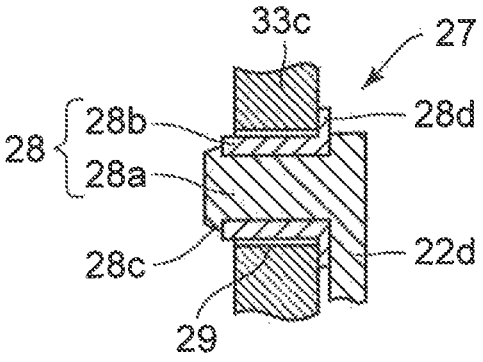

Also, on a lower portion at the front end of the hammer arm 33, a mount section 33*c* is provided projecting downward, as depicted in FIG. 3 and FIG. 8A. That is, the mount section 33*c* is structured to oppose a side surface of the support section 22*d* of the transmission member 10 and, in this state, move in the vertical direction along the side surface of the support section 22*d*. Also, the mount section 33*c* is provided with a guide hole 29 for guiding an interlock projecting section 28 of the interlock control section 27 described later.

Also, the hammer arm 33 is structured such that a lower portion of its rear end comes in contact with a lower-limit stopper 35 from above and thereby is regulated at a lower-limit position that is an initial position, as depicted in FIG. 2 and FIG. 3. That is, the lower-limit stopper 35 is mounted on a lower-limit stopper rail 36 supported by a plurality of stopper support sections 17 provided on the transmission support rail 14. As a result, the hammer member 11 is structured to be positionally regulated at the initial position with it being slanted downward to the rear, by the lower portion at the rear end of the hammer arm 33 coming in contact with the lower-limit stopper 35 from above.

Moreover, the hammer arm 33 is structured such that each of the white-key stopper contact section 43*a* and the black-key stopper contact section 43*b* provided at its upper portion at the rear end comes in contact with the upper-limit stopper 37 from below, whereby the upper-limit position of the hammer arm 33 is regulated, as depicted in FIG. 7A, FIG. 7B, FIG. 7C, FIG. 7D, and FIG. 9. That is, the white keys 2*a* and the black keys 2*b* have different lengths in the front and rear direction, and the lengths of the white keys 2*a* are longer than the lengths of the black keys 2*b*.

Accordingly, each key stroke of the white keys 2*a* and the black keys 2*b* are adjusted by the cushion members 6*a* and 6*b* on the front side and the cushion member 7 on the rear side, and the length for a white key 2*a* to press up the transmission member 10 and the length for a black key 2*b* to press up the transmission member 10 are different from each other. That is, the amount of rotation (that is, rotation angle) of the hammer member 11 corresponding to the white key 2*a* when rotating around the hammer holding shaft 31 of the hammer holding member 13 is smaller than the amount of rotation (that is, rotation angle) of the hammer member 11 corresponding to the black key 2*b*.

Accordingly, in order to bring the hammer member 11 corresponding to the white key 2*a* and the hammer member 11 corresponding to the black key 2*b* into contact with the upper-limit stopper 37 with the same amount of rotation (that is, at the same rotation angle), it is required to adjust the height of projection of the white-key stopper contact section 43*a* and the height of projection of the black-key stopper contact section 43*b*. Therefore, the white-key stopper contact section 43*a* is formed at a height substantially equal to the upper surface of the hammer arm 33. Also, the black-key stopper contact section 43*b* is formed projecting from the upper surface of the hammer arm 33.

Figure 9:
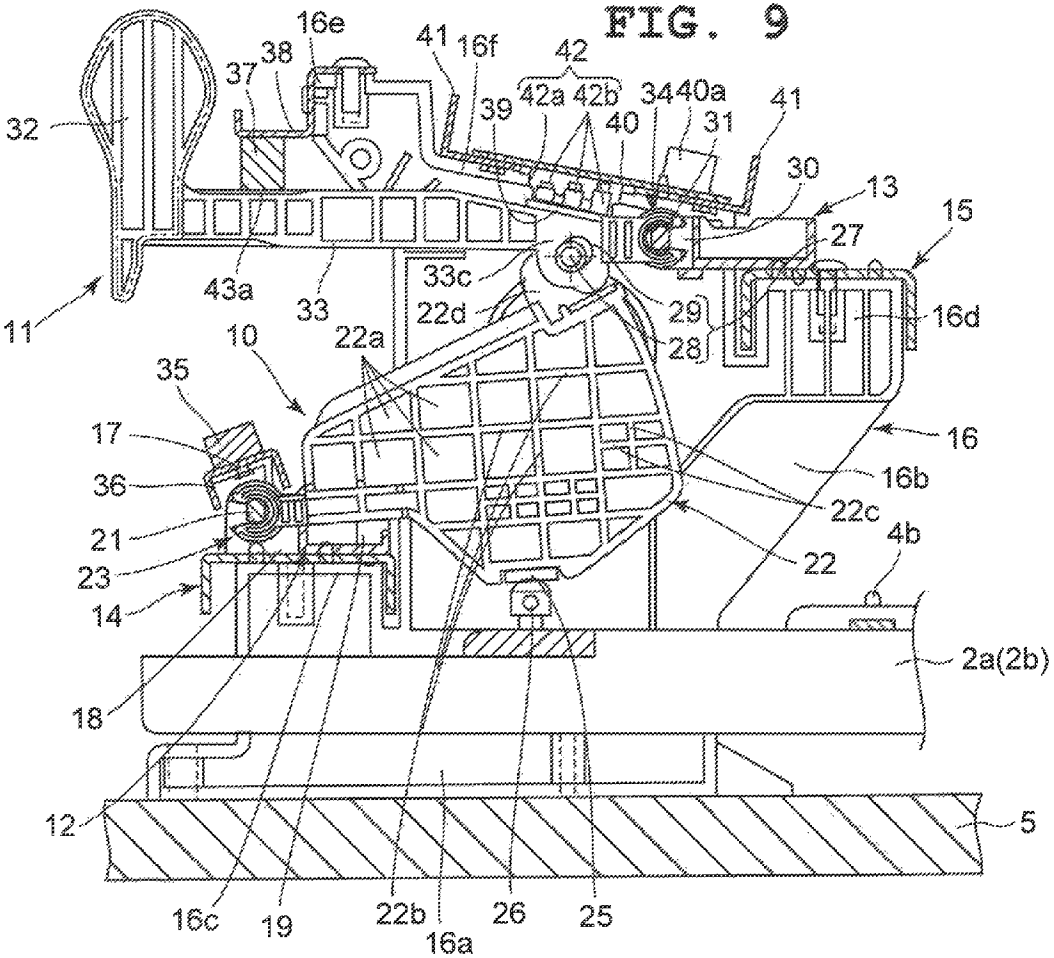
FIG. 9 is an enlarged sectional view of the main portion of the keyboard device depicted in FIG. 3, in which a key has been depressed.

Here, the upper-limit stopper 37 is mounted on the lower surface of an upper-limit stopper rail 38 supported by each stopper rail support section 16*e* of the plurality of support members 16, as depicted in FIG. 9. As a result, the hammer member 11 is structured such that, when the hammer arm 33 is rotated around the hammer holding shaft 31 of the hammer holding member 13 in the clockwise direction, the upper portion at the rear end of the hammer arm 33 comes in contact with the upper-limit stopper 37 from below, whereby the upper-limit position of the hammer member 11 is regulated.

Also, at an upper portion at the front end of the hammer arm 33, a switch pressing section 39 is formed, as depicted in FIG. 2 and FIG. 9. In an area above this switch pressing section 39 of the hammer arm 33, a switch substrate 40 is arranged by a pair of substrate support rails 41. These substrate support rails 41 are long plates each formed in an L shape in cross section, and have a length corresponding to the entire length of the keys 2 in the array direction.

These substrate support rails 41 are mounted such that their horizontal portions are away from each other by a predetermined space on the substrate support section 16*f* of each of the plurality of support members 16, as depicted in FIG. 1 to FIG. 3. The switch substrate 40 is divided into a plurality of portions, as depicted in FIG. 1. In the present embodiment, the switch substrate 40 is divided into four portions each having a length corresponding to twenty keys 2, and mounted on the pair of substrate support rails 41.

On the lower surface of each of the switch substrates 40, a rubber switch 42 is provided, as depicted in FIG. 2 and FIG. 9. The rubber switch 42 has an inverted-dome-shaped bulging section 42*a* formed on a rubber sheet elongated in the array direction of the keys 2 in a manner to correspond to each of the plurality of hammer arms 33. Inside the bulging section 42*a*, a plurality of movable contacts 42*b* that separably come in contact with a plurality of fixed contacts (not depicted) provided on the lower surface of the switch substrate 40 are provided along the front and rear direction of the hammer arm 33.

As a result, the rubber switch 42 is structured such that, when the hammer member 11 rotates around the hammer holding shaft 31 of the hammer holding member 13 in the clockwise direction and is pressed from below by the switch pressing section 39 of the hammer arm 33, the inverted-dome-shaped bulging section 42*a* is elastically deformed, and the plurality of movable contacts 42*b* sequentially come in contact with the plurality of fixed contacts with time, whereby a switch signal according to the strength of the key depression operation on the key 2 is outputted. This switch signal is then supplied to a sound source section 40*a*, and a musical sound in accordance with the key depression strength on the key 2 is generated, as depicted in FIG. 9.

The interlock control section 27 has the interlock projecting section 28 provided to the support section 22*d* of the transmission member 10 and the guide hole 29 provided to the mount section 33*c* of the hammer member 11 for guiding the interlock projecting section 28, as depicted in FIG. 2 and FIG. 3. As a result, the interlock control section 27 is structured to control the rotating motion of the hammer member 11 in accordance with the rotating motion of the transmission member 10 corresponding to the key 2 subjected to a key depression operation by a relative motion of the interlock projecting section 28 with respect to the guide hole 29.

Figure 8B:
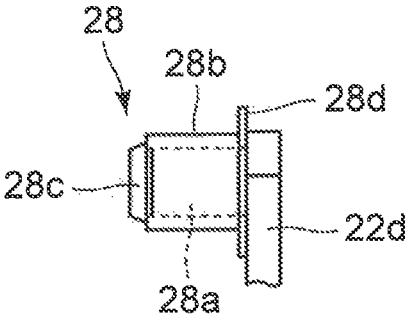
Figure 8C:
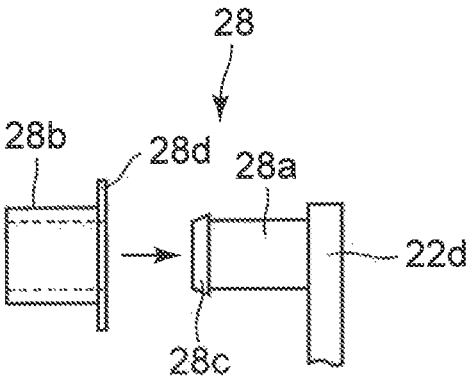

That is, the interlock projecting section 28 of the interlock control section 27 includes a rod-shaped projection body 28*a* and a cylindrical shock-absorbing section 28*b* provided on the outer periphery of the projection body 28*b*, as depicted in FIG. 8A to FIG. 8C. The projection body 28*a* is formed in a round-bar shape, as depicted in FIG. 8A to FIG. 8C.

This projection body 28*a* is integrally formed on an upper portion at the front end of the support section 22*d* provided to the transmission body section 22 of the transmission member 10 such that it projects toward the array direction of the keys 2, and movably inserted into the guide hole 29 provided in the mount section 33*c* of the hammer member 11, as depicted in FIG. 8A to FIG. 8C. Also, the projection body 28*a* has a hook portion 28*c* annularly formed on the outer perimeter of its tip.

The shock-absorbing section 28*b* is made of synthetic resin with elasticity such as urethane resin or silicone resin, and has a substantially cylindrical shape, as depicted in FIG. 8A to FIG. 8C. This shock-absorbing section 28*b* is formed such that its inner diameter is substantially equal to that of the projection body 28*a* and its length in the axial direction is equal to the length of the projection body 28*a* in the axial direction, that is, a length between the support section 22*d* and the hook section 28*c*.

At one end portion of the shock-absorbing section 28*b*, a sliding projection 28*d* which comes in contact with the support section 22*d* is formed in a flange shape, as depicted in FIG. 8A to FIG. 8C. As a result, the shock-absorbing section 28*b* is structured such that, when the shock-absorbing section 28*b* is mounted on the outer periphery of the projection body 28*a*, the flange-shaped sliding projection 28*d* comes in contact with the support section 22*d* and an end portion on the opposite side comes in contact with the hook section 28*c* of the projection body 28*a*, whereby the shock-absorbing section 28*b* is mounted on the projection body 28*a* with it being interposed between the support section 22*c* and the hook section 28*c*.

On the other hand, the guide hole 29 of the interlock control section 27 is a long hole into which the interlock projecting section 28 is movably inserted, and provided in the mount section 33*c* provided on a lower portion at the front end of the hammer arm 33 of the hammer member 11, as depicted in FIG. 3, FIG. 8A, and FIG. 9. The guide hole 29 is a long hole elongated along a relative motion path (that is, moving path) of the interlock projecting section 28 when the transmission member 10 performs a rotating motion around the transmission holding shaft 21 and the hammer member 11 performs a rotating motion around the hammer holding shaft 31.

That is, the guide hole 29 is provided such that its center line in the longitudinal direction is slanted downward to the rear (in FIG. 3, downward to the left), as depicted in FIG. 3, FIG. 8A, and FIG. 9. Also, the guide hole 29 is formed such that its length (hole width) in a direction orthogonal to the longitudinal direction is substantially equal to the outer diameter of the interlock projecting section 28, that is, the outer diameter of the shock-absorbing section 28*b*, and its length in the longitudinal direction is substantially one and a half or two times as long as the outer diameter of the interlock projecting section 28.

Here, the guide hole 29 is structured such that, when it moves with the interlock projecting section 28 being inserted thereinto, the shock-absorbing section 28*b* of the interlock projecting section 28 moves while elastically coming in contact with the inner peripheral surface of the guide hole 29, and a sliding projection 29*d* of the shock-absorbing section 28*b* slides while elastically coming in contact with a side edge portion of the guide hole 29, that is, the side surface of the mount section 33*c* of the hammer member 11, whereby the mount section 33*c* of the hammer member 11 is prevented from directly coming in contact with the support section 22*d* of the transmission member 10, as depicted in FIG. 3, FIG. 8A, and FIG. 9.

Thus, the interlock control section 27 is structured such that, when the transmission member 10 corresponding to a key 2 subjected to a key depression operation makes a rotating motion and the hammer member 11 makes a rotating motion along with this rotating motion of the transmission member 10, the rotating motion of the hammer member 11 is controlled by a relative motion of the interlock projecting section 28 with respect to the guide hole 29, as depicted in FIG. 3 and FIG. 9.

That is, the interlock control section 27 is structured such that, when the key 2 is subjected to a key depression operation and the transmission member 10 rotates around the transmission holding shaft 21 in the counterclockwise direction, the interlock projecting section 28 comes in contact with the upper portion at the front end of the guide hole 29 in response to the rotation of the transmission member 10 and presses up the upper portion at the front end of the guide hole 29, whereby the hammer member 11 is rotated around the hammer holding shaft 31 in the clockwise direction, as depicted in FIG. 3.

Also, this interlock control section 27 is structured such that, when the hammer member 11 is pressed upward, the interlock projecting section 28 becomes movable along the guide hole 29, whereby the transmission member 10 and the hammer member 11 can make a rotating motion in conjunction with each other regardless of whether or not the rotation speed of the transmission member 10 and the rotation speed of the hammer member 11 are the same, as depicted in FIG. 9.

Moreover, this interlock control section 27 is structured such that, when the key 2 subjected to a key depression operation is to return to the initial position, since the interlock projecting section 28 is in a state of being relatively movable with respect to the guide hole 29, the transmission member 10 rotates around the transmission holding shaft 21 in the clockwise direction by its self weight, and the hammer member 11 rotates around the hammer holding shaft 31 in the counterclockwise direction by its self weight, as depicted in FIG. 9.

Furthermore, the interlock control section 27 is structured such that, when the transmission member 10 and the hammer member 11 return to their initial positions, the interlock projecting section 28 moves toward the upper portion at the front end of the guide hole 29, whereby the interlock projecting section 28 comes in contact with or approaches the upper portion at the front end of the guide hole 29, as depicted in FIG. 3.

Next, the operation of the above-described keyboard device 1 of the electronic keyboard instrument is described.

In the keyboard device 1, in an initial state in which no key depression operation has been performed on the keys 2, the transmission member 10 rotates by its self weight around the transmission holding shaft 21 of the transmission holding section 12 in the clockwise direction, and the transmission felt 25 provided on the lower surface of the transmission body section 22 comes in contact with the capstan 26 of the corresponding key 2 from above.

Here, the weight of the transmission member 10, that is, the weight set by the shape and thickness of the vertical plate section 22*a* of the transmission body section 22 and the formation density of the plurality of rib sections 22*b* and 22*c* is applied to the capstan 26 of the key 2 from above. As a result, the key 2 is pressed by the transmission member 10 to rotate around the balance pins 4*a* and 4*b* in the counterclockwise direction, and the rear end of the key 2 comes in contact with the cushion members 6*a* and 6*b* to regulate the key 2 at its initial position and to regulate the transmission member 10 at its initial position.

Also, here, the hammer member 11 rotates by its self weight around the hammer holding shaft 31 of the hammer holding member 13 in the counterclockwise direction, whereby the hammer arm 33 comes in contact with the lower-limit stopper 36 and is positionally regulated at a lower-limit position. In this state, the switch pressing section 39 of the hammer member 11 has been arranged at a position below and away from the rubber switch 42 of the switch substrate 40. As a result, the rubber switch 42 is in a free state with its bulging section 42*a* being bulged, and also in an OFF state by the plurality of movable contacts 42*b* being away from fixed contacts (not depicted).

Next, a case is described in which the key 2 in the above-described state is depressed for musical performance.

In this case, when the key 2 is depressed, the key 2 rotates around the balance pins 4*a* and 4*b* in the clockwise direction in FIG. 3, and the capstan 26 of the key 2 presses up the transmission member 10. Here, the weight of the transmission member 10 set by the shape and thickness of the vertical plate section 22*a* of the transmission body section 22 and the formation density of the plurality of rib sections 22*b* and 22*c* is provided to the key 2 as an initial load.

As a result, the transmission member 10 rotates against its self weight around the transmission holding shaft 21 of the transmission holding member 12 in the counterclockwise direction in FIG. 3. Then, the rotating motion of the transmission member 10 is transmitted by the interlock control section 27 to the hammer member 11, and the hammer member 11 is pressed up against its self weight. That is, when the transmission member 10 rotates in the counterclockwise direction in FIG. 3, the interlock projecting section 28 comes in contact with the upper portion at the front end of the guide hole 29 in response to the rotation of the transmission member 10 and presses up the upper portion at the front end of the guide hole 29.

As a result, the hammer member 11 rotates around the hammer holding shaft 31 of the hammer holding member 13 in the clockwise direction in FIG. 3, and thereby provides an action load to the key 2. That is, when the hammer member 11 rotates around the hammer holding shaft 31 in the clockwise direction in FIG. 3, an action load is provided to the key 2 by the moment of inertia of the hammer member 11. Here, the hammer arm 33 has been formed such that its length in the front and rear direction of the key 2 is substantially equal to the length of the transmission member 10 and has the hammer section 32 formed at the rear end portion of the hammer arm 33, as depicted in FIG. 3 and FIG. 9.

In addition, the hammer fitting section 34 of the hammer arm 33 has been rotatably mounted on the hammer holding shaft 31 in this state. Accordingly, when the hammer member 11 rotates around the hammer holding shaft 31 in the clockwise direction, a moment of inertia occurs in the hammer member 11. A load by this moment of inertia is provided as an action load to the key 2 via the interlock control section 27 and the transmission member 10. As a result, a key-touch feel close to that of an acoustic piano can be acquired.

When the hammer member 11 displaces around the hammer holding shaft 31 in the clockwise direction as described above, the switch pressing section 39 of the hammer arm 33 presses the inverted-dome-shaped bulging section 42*a* of the rubber switch 42 provided to the switch substrate 40 from below, as depicted in FIG. 9. As a result, the inverted-dome-shaped bulging section 42*a* is elastically deformed and the plurality of movable contacts 42*b* in the bulging section 42*a* sequentially come into contact with the plurality of fixed contacts at time intervals.

Here, a switch signal corresponding to the depressed key 2 is supplied to the sound source section 40*a*, and musical sound data is generated therein. Subsequently, based on the generated musical sound data, a musical sound is emitted from a loudspeaker (not depicted) serving as a sound emitting section. Then, when the hammer member 11 further displaces around the hammer holding shaft 31 in the clockwise direction, the hammer arm 33 comes in contact with the upper-limit stopper 37 from below to regulate and stop the displacement of the hammer member 11.

Here, for example, when the hammer member 11 corresponding to a white key 2*a* displaces, the white-key stopper contact section 43*a* of the hammer arm 33 comes in contact with the upper-limit stopper 37 from below. When the hammer member 11 corresponding to a black key 2*b* displaces, the black-key stopper contact section 43*b* of the hammer arm 33 comes in contact with the upper-limit stopper 37 from below.

In this embodiment, the white-key stopper contact section 43*a* has been formed at a height substantially equal to the upper surface of the hammer arm 33, and the black-key stopper contact section 43*b* has been formed projecting from the upper surface of the hammer arm 33. Thus, even though the white key 2*a* and the black key 2*b* have different lengths in the front and rear direction and the length of the white key 2*a* is longer than the length of the black key 2*b*, the hammer member 11 corresponding to the white key 2*a* and the hammer member 11 corresponding to the black key 2*b* come in contact with the upper-limit stopper 37 with the same amount of displacement (displacement angle). Note that, as in a normal piano, the amount of displacement of the white key may be slightly larger than the amount of displacement of the black key.

Then, when a key release motion (returning motion) for returning the key 2 to its initial position is started, the transmission member 10 displaces in the clockwise direction by its self weight to return to its initial position with the interlock projecting section 28 being relatively movable with respect to the guide hole 29, and the hammer member 11 displaces in the counterclockwise direction by its self weight to return to its initial position. As a result, the key 2 returns to its initial position, and the interlock projecting section 28 of the interlock control section 27 comes in contact with or approaches the upper portion at the front end of the guide hole 29.

In the above-described keyboard device 1, when a key 2 is subjected to a key depression operation by a light force (weak force), this key 2 slowly displaces around the balance pins 4*a* and 4*b* in the clockwise direction and the capstan 26 of the key 2 slowly presses up the transmission member 10. Here, the weight of the transmission member 10 set by the shape and thickness of the vertical plate section 22*a* of the transmission body section 22 and the formation density of the plurality of rib sections 22*b* and 22*c* is provided to the key 2 as a static load.

As a result, the transmission member 10 slowly displaces against its self weight around the transmission holding shaft 21 of the transmission holding member 12 in the counterclockwise direction, and the interlock projecting section 28 of the interlock control section 27 slowly presses up the upper portion at the front end of the guide hole 29. Accordingly, the hammer member 11 slowly rotates around the hammer holding shaft 31 of the hammer holding member 13 in the clockwise direction to provide an action load to the key 2.

Then, the switch pressing section 39 of the hammer member 11 presses the rubber switch 42 provided to the switch substrate 40 and causes it to make a switching motion, whereby the upper portion at the rear end of the hammer member 11 comes in contact with the upper-limit stopper 37 from below and stops the displacement of the hammer member 11.

Here, a state is maintained in which the interlock projecting section 28 of the interlock control section 27 is in contact with the upper portion at the front end of the guide hole 29. In this state, when a key release motion (returning motion) for returning the key 2 to its initial position is started, the transmission member 10 displaces in the clockwise direction by its self weight and returns to the initial position with the interlock projecting section 28 of the interlock control section 27 being in contact with or positioned near the upper portion at the front end of the guide hole 29. In addition, the hammer member 11 displaces in the counterclockwise direction by its self weight and returns to the initial position. As a result, the key 2 returns to the initial position.

In the above-described keyboard device 1, when a key 2 is subjected to a key depression operation by a strong force, this key 2 quickly displaces around the balance pins 4*a* and 4*b* in the clockwise direction and the capstan 26 of the key 2 presses up the transmission member 10 at high speed. Here, acceleration occurs to the transmission body section 22 of the transmission member 10.

Accordingly, a dynamic load occurs in accordance with the weight set by the shape and thickness of the vertical plate section 22*a* of the transmission body section 22 and the formation density of the plurality of rib sections 22*b* and 22*c* and the barycenter position G set by the shape and thickness of the vertical plate section 22*a* and the formation positions of the plurality of rib sections 22*b* and 22*c*, and this dynamic load is provided to the key 2 and the hammer member 11.

As a result, the transmission member 10 rotates at high speed around the transmission holding shaft 21 of the transmission holding member 12 in the counterclockwise direction. Here, the interlock projecting section 28 of the interlock control section 27 abruptly presses up the upper portion at the front end of the guide hole 29. Accordingly, the hammer member 11 abruptly and quickly rotates around the hammer holding shaft 31 of the hammer holding member 13 in the clockwise direction and provides an action load to the key 2. Here, when the rotation speed of the hammer member 11 is higher than the rotation speed of the transmission member 10, the upper portion at the front end of the guide hole 29 of the interlock control section 27 moves away from the interlock projecting section 28, and the interlock projecting section 28 relatively moves inside the guide hole 29 toward its lower portion at the rear end.

Then, the switch pressing section 39 of the hammer member 11 abruptly presses the rubber switch 42 provided on the switch substrate 40 so that it makes a switching motion, and the upper portion at the rear end of the hammer member 11, that is, the white-key stopper contact section 43*a* or the black-key stopper contact section 43*b* abruptly comes in contact with the upper-limit stopper 37 from below. As a result, the hammer member 11 is bounced back by the upper-limit stopper 37.

Here, since the interlock projecting section 28 of the interlock control section 27 is relatively separated from the upper portion at the front end of the guide hole 29 as depicted in FIG. 9, the hammer member 11 rotates around the hammer holding shaft 31 in the counterclockwise direction, and the upper portion at the front end of the guide hole 29 of the interlock control section 27 comes in contact with or approaches the interlock projecting section 28. Accordingly, the hammer member 11 stops at a position away from the upper-limit stopper 37, or slightly rotates the transmission member 10 in the clockwise direction, whereby the bounce of the hammer member 11 is inhibited.

Then, when a key release motion (returning motion) for returning the key 2 to its initial position is started, the interlock projecting section 28 of the interlock control section 27 comes in contact with the upper portion at the front end of the guide hole 29 with it being movable along the guide hole 29. In this state, the transmission member 10 rotates in the clockwise direction by its self weight, and thereby returns to the initial position. In addition, the hammer member 11 rotates in the counterclockwise direction by its self weight, and thereby returns to the initial position. As a result, the key 2 returns to the initial position.

Also, in a so-called sequential depression operation of sequentially depressing one key 2 of the keyboard device 1, this key 2 is subjected to a key depression operation once, and then subjected to a key depression operation again while the hammer member 11, the transmission member 10, and the key 2 are returning to their initial positions after the hammer member 11 is pressed up and reaches the upper-limit position.

Here, the interlock projecting section 28 of the interlock control section 27 can move along the guide hole 29. Therefore, the hammer member 11 and the transmission member 10 make returning motions toward their initial positions by their own weights regardless of whether or not the rotation speed of the hammer member 11 in the returning direction and the rotation speed of the transmission member 10 in the returning direction are the same, and the key 2 also performs a returning motion along with it toward the initial position. Subsequently, when the key 2 is again subjected to a key depression operation in the course of its returning motion, the transmission member 10 in the course of returning to the initial position is again pressed up by the capstan 26 of the key 2.

Then, the transmission member 10 in the course of returning to the initial position rotates again around the transmission holding shaft 12 in the counterclockwise direction. Here, the interlock projecting section 28 of the interlock control section 27 moves along the guide hole 29, and presses up the upper portion at the front end of the guide hole 29. As a result, the hammer member 11 in the course of returning to the initial position rotates again around the hammer holding shaft 31 in the clockwise direction, provides an action load to the key 2, and presses the rubber switch 42 so that it makes a switching motion.

That is, for a sequential depression operation on one key 2, the retuning motion of the hammer member 11 and the returning motion of the transmission member 10 are controlled by a relative movement of the interlock projecting section 28 with respect to the guide hole 29 of the interlock control section 27. As a result, the sequential depression operation of sequentially depressing one key 2 can be favorably performed, whereby the sequential depression performance is improved.

As described above, the keyboard device 1 of the electronic keyboard instrument includes the plurality of transmission members 10 which is provided corresponding to the plurality of keys 2 and displaced in accordance with key depression operations on the plurality of keys 2 and the plurality of hammer members 11 which is provided corresponding to the plurality of keys 2 and each of which performs a rotating motion in accordance with the displacement of the transmission member 10 corresponding to a depressed key 2 so as to provide an action load to the depressed key 2. In addition, the weight of the transmission member 10 is set in accordance with the formation density of the plurality of rib sections 22*b* and 22*c* formed on the transmission body section 22. Therefore, a favorable key touch can be acquired with a simple structure.

That is, in the keyboard device 1 of the electronic keyboard instrument, the weight of the transmission member 10 can be set in accordance with the formation density of the plurality of rib sections 22*b* and 22*c* formed on the transmission body section 22. Therefore, this set weight of the transmission member 10 can be provided to the corresponding key 2 as a static load. As a result, an initial load on the key 2 can be optimized and a key depressing force on the key 2 at the time of key depression can be favorably transmitted to the hammer member 11 as a static load. Accordingly, a favorable key touch can be acquired with a simple structure.

Here, the transmission body section 22 is made of hard synthetic resin such as ABS resin and have the thin vertical plate section 22*a*, the plurality of rib sections 22*b* formed in an substantially lattice shape on the outer peripheral portion and both side surfaces of the vertical plate section 22*a*, and the plurality of fine-grid rib sections 22*c* further provided in part of the cells in the lattice. Therefore, the weight of the transmission member 10 can be set by the formation density of the plurality of rib sections 22*b* and 22*c*, and the transmission body section 22 can be easily manufactured by using a metal mold for molding.

Also, the keyboard device 1 of the electronic keyboard instrument includes the plurality of transmission members 10 which is provided corresponding to the plurality of keys 2 and displaced in accordance with key depression operations on the plurality of keys 2 and the plurality of hammer members 11 which is provided corresponding to the plurality of keys 2 and each of which performs a rotating motion in accordance with the displacement of the transmission member 10 corresponding to a depressed key so as to provide an action load to the depressed key 2. In addition, the barycenter position G of the transmission member 10 is set in accordance with the formation positions of the plurality of rib sections 22*b* and 22*c* formed on the transmission body section 22. Therefore, a favorable key touch can be acquired with a simple structure.

That is, in the keyboard device 1 of the electronic keyboard instrument, the barycenter position G of the transmission member 10 can be set in accordance with the formation positions of the plurality of rib sections 22*b* and 22*c* formed on the transmission body section 22. Therefore, when the transmission member 10 is displaced by the corresponding key 2 subjected to a key depression operation, an dynamic load can be provided to the key 2 by the barycenter position G of the transmission member 10 set in accordance with the formation positions of the plurality of rib sections 22*b* and 22*c* formed on the transmission body section 10. In addition, a key depressing force on a key 2 at the time of key depression can be favorably transmitted to the hammer member 11 as a dynamic load. As a result, a favorable key touch can be acquired with a simple structure.

Also, here, the transmission body section 22 is made of hard synthetic resin such as ABS resin and have the thin vertical plate section 22*a*, the plurality of rib sections 22*b* formed in an substantially lattice shape on the outer peripheral portion and both side surfaces of the vertical plate section 22*a*, and the plurality of fine-grid rib sections 22*c* further provided in part of the cells in the lattice. Therefore, the barycenter position G of the transmission member 10 can be set by the formation state of the plurality of rib sections 22*b* and 22*c*, that is, the formation positions of the plurality of fine rib sections 22*c* provided to part of the plurality of rib sections 22*b*, at a position shifted from the center of the transmission body section 22. In addition, the transmission body section 22 can be easily manufactured by using a metal mold for molding.

As described above, in the keyboard device 1 of the electronic keyboard instrument, the weight of the transmission member 10 can be set in accordance with the formation density of the plurality of rib sections 22*b* and 22*c* formed on the transmission body section 22, and the barycenter position G of the transmission member 10 can be set in accordance with the formation positions of the plurality of rib sections 22*b* and 22*c* formed on the transmission body section 22.

Accordingly, in the keyboard device 1, the set weight of the transmission member 10 can be provided to the corresponding key 2 as a static load, and a key depressing force on the key 2 at the time of key depression can be favorably transmitted to the hammer member 11 as a static load. Also, when the transmission member 10 is displaced by the corresponding key 2 subjected to a key depression operation, a dynamic load can be provided to the key 2 by the set barycenter position G of the transmission member 10. In addition, a key depressing force on a key 2 at the time of key depression can be favorably transmitted to the hammer member 11 as a dynamic load.

Figure 10:
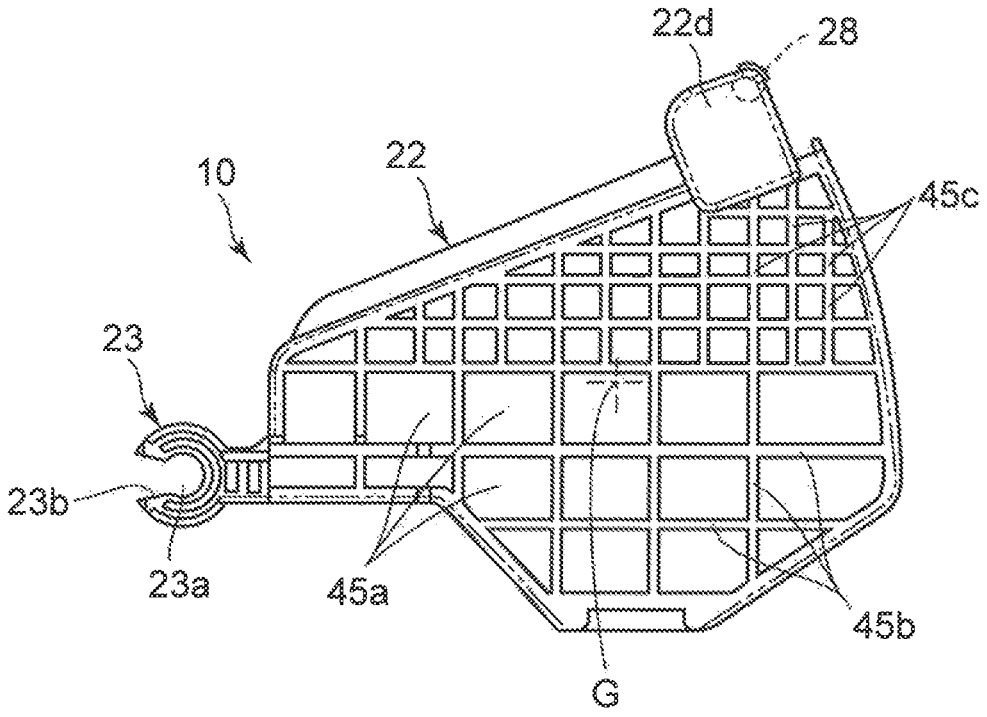
FIG. 10 is an enlarged side view of a modification example of the transmission member in the keyboard device to which the present invention has been applied.

In the above-described embodiment, the transmission body section 22 is structured to have the plurality of rib sections 22*b* formed in an substantially lattice shape on both side surfaces of the thin vertical plate section 22*a* and the plurality of finer-grid rib sections 22*c* with an increased number of ribs formed in part of the cells in the lattice. However, the present invention is not limited to thereto, and may be structured as shown in a modification example depicted in FIG. 10.

That is, in the transmission body section 22 of the modification example, a plurality of rib sections 45*b* are formed having a large-grid lattice shapes on the lower side of the center on both side surfaces of a thin vertical plate section 45*a*, and a plurality of rib sections 45*c* is formed having a small-grid lattice shape with an increased number of ribs on the upper side of the center of both side surfaces of the vertical plate section 45*a*.

In this transmission body section 22, the weight of the transmission member 10 can be set in accordance with the formation density of the plurality of rib sections 45*b* and 45*c*. Therefore, the set weight of the transmission member 10 can be provided to the corresponding key 2 as a static load, and the barycenter position G of the transmission member 10 can be set at a position higher than that in the above-described embodiment in accordance with the formation positions of the plurality of rib sections 45*b* and 45*c* formed on the transmission body section 22. As a result of this structure, a dynamic load different from that of the above-described embodiment can be provided to a key 2.

Also, the present invention is not limited to the above structure, and the weight of the transmission member 10 may be set by changing the entire thickness of the vertical plate sections 22*a* and 45*a* of the transmission body section 22.

Figure 11A:
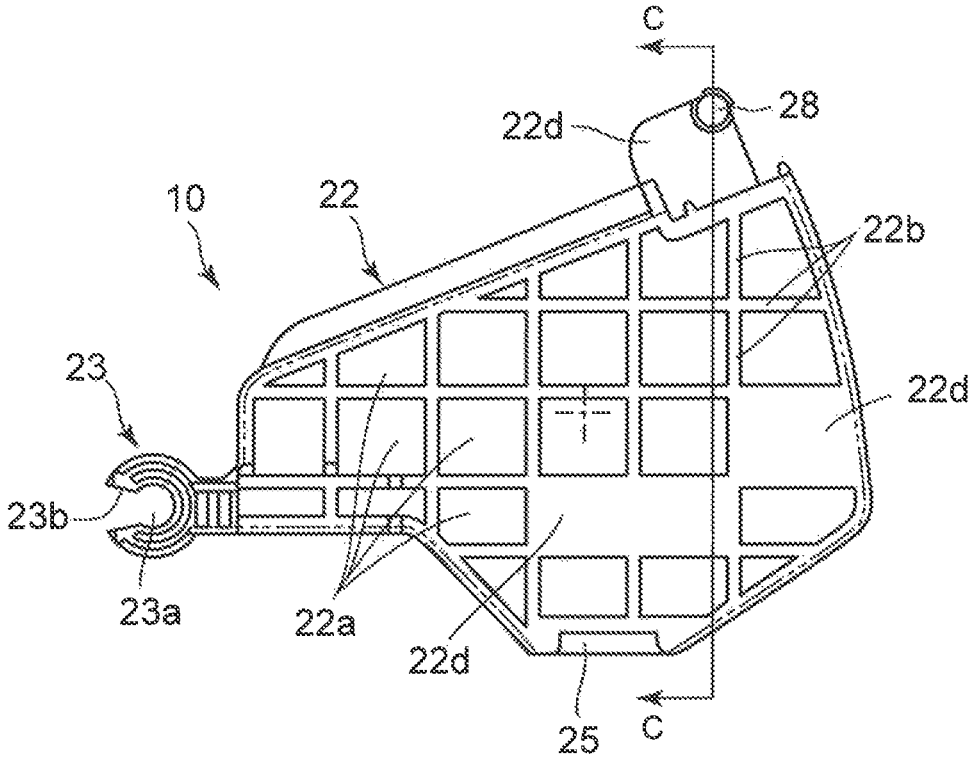
Figure 11B:
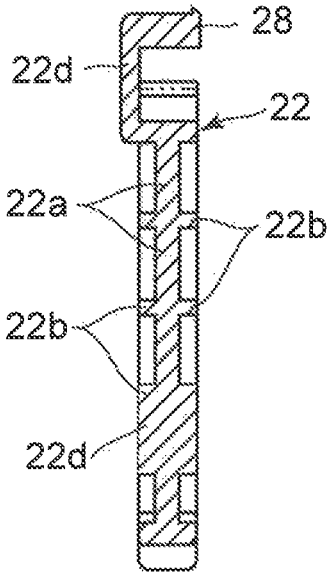

Also, instead of increasing the number of ribs formed in the cells, the weight and the barycenter position G of the transmission member 10 may be set by providing, in a cell whose weight is desired to be increased, a vertical plate section 22*d* thicker than the vertical plate section 22*a* in another cell as a barycenter position setting member of the present invention, as depicted in FIG. 11A and FIG. 11B. In addition, it is also possible to change the vertical plate section 22*a* in the cell whose weight is desired to be increased to a member made of a heavier-weight material.

Figure 12A:
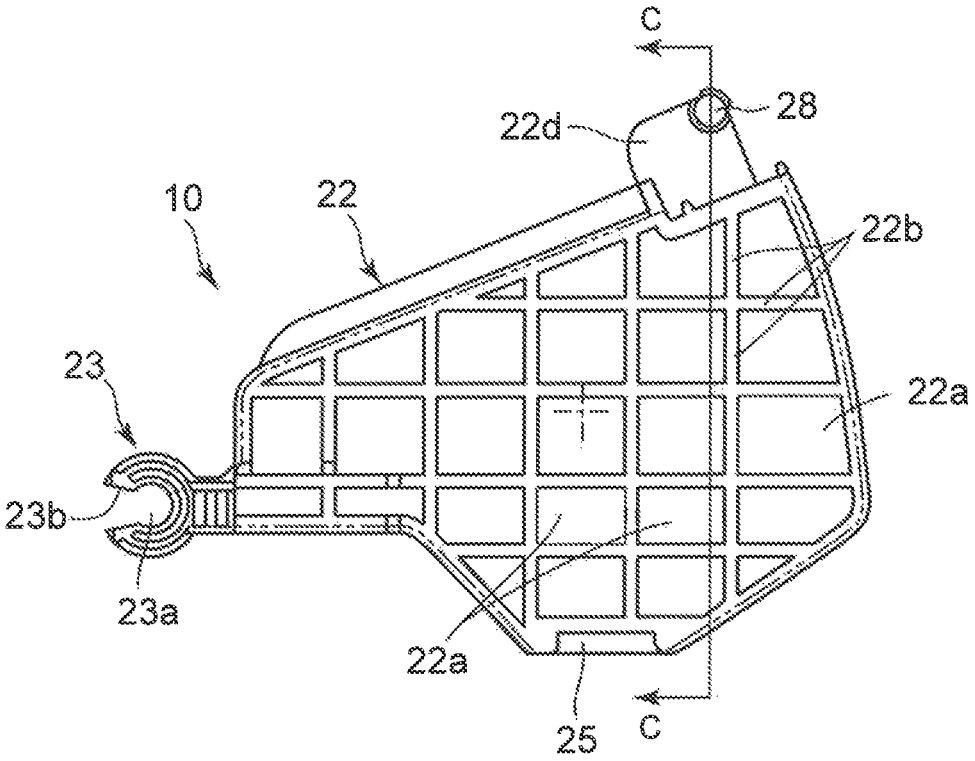
Figure 12B:
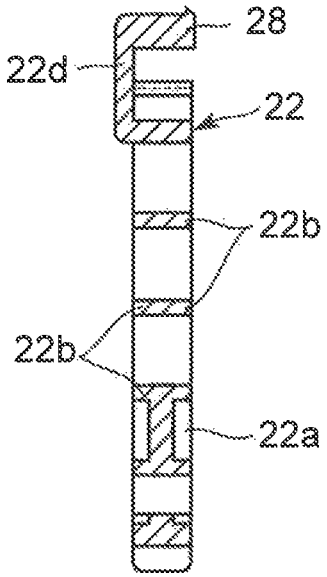

Moreover, a structure may be adopted in which the transmission body section 22 is formed of only the plurality of rib sections 22*b* formed in a lattice shape, and the vertical plate section 22*a* serving as a barycenter position setting member of the present invention is provided only in a cell whose weight is desired to be increased while no vertical plate section is provided in the other cells, as depicted in FIG. 12A and FIG. 12B.

Furthermore, in the present embodiment, the weight of the rib sections is increased by forming a plurality of finer-grid rib sections by increasing the number of ribs formed in part of the cells. However, instead of increasing the number of ribs to be formed, each rib may be thickened to increase the entire weight of the rib sections.

Still further, in the above-described embodiment, the interlock projecting section 28 of the interlock control section 27 is provided to the transmission member 10 and the guide hole 29 is provided in the hammer member 11. However, the present invention is not limited thereto. For example, a structure may be adopted in which the interlock projecting section 28 is provided to the guide mount section 33*c* of the hammer member 11 and the guide hole 29 is provided in the support section 22*d* of the transmission member 10.

In this structure, when a key 2 is depressed by a weak force, the hammer member 11 can be slowly pressed up and rotated with the interlock projecting section 28 of the hammer member 11 being in contact with the lower portion at the rear end of the guide hole 29. Also, when the key 2 is to return to the initial position, the transmission member 10 and the hammer member 11 can be each returned to the initial position with the interlock projecting section 28 of the hammer member 11 being in contact with the lower portion at the rear end of the guide hole 29.

Also, when a key 2 is depressed by a strong force, the lower portion at the rear end of the guide hole 29 of the transmission member 10 strongly comes in contact with and presses up the interlock projecting section 28 of the hammer member 11, whereby the hammer member 11 can be rotated strongly. Here, even though the hammer member 11 strongly comes in contact with and bounces off the upper-limit stopper 37, the interlock projecting section 28 can be moved along the guide hole 29.

Accordingly, with this interlock control section 27 as well, the interlock projecting section 28 of the hammer member 11 can be moved toward the lower portion at the rear end of the guide hole 29 of the transmission member 10 when the hammer member 11 rotates toward the initial position earlier than the transmission member 10. Therefore, the rotating motion of the hammer member 11 can be controlled by a relative motion of the interlock projecting section 28 with respect to the guide hole 29. Thus, an unnatural and unnecessary motion of the hammer member 11 can be inhibited, and therefore a key-touch feel close to that of an acoustic piano can be acquired, as with the above-described embodiment.

In addition, even in a sequential key depression operation of sequentially depressing one key 2, the returning motion of the hammer member 11 and the returning motion of the transmission member 10 can be controlled by a relative motion of the interlock projecting section 28 with respect to the guide hole 29 of the interlock control section 27. As a result, the sequential key depression operation of sequentially depressing one key 2 can be reliably and favorably performed, whereby the sequential key depression performance can be improved.

Moreover, in the above-described embodiment, a guide section for guiding the interlock projecting section 28 of the interlock control section 27 is the guide hole 29. However, the guide section is not necessarily the guide hole 29, and may be a guide groove section having a guide wall. In this case as well, the guide groove section is only required to be formed by being elongated along a relative motion path of the interlock projecting section 28.

Furthermore, in the above-described embodiment and the modification examples, the interlock projecting section 28 of the interlock control section 27 is provided to the support section 22*d* of the transmission member 10 or the mount section 33*c* of the hammer member 11 in a cantilever shape. However, the present invention is not limited thereto. For example, the interlock projecting section 28 may be provided in a both-end-support beam shape.

Still further, in the above-described embodiment, the transmission member is structured to perform a rotating motion. However, the present invention is not limited thereto. For example, a structure may be adopted in which a key depressing force is transmitted to the hammer member 11 by the vertical displacement (movement) of the transmission member in response to the key depression.

While the present invention has been described with reference to the preferred embodiments, it is intended that the invention be not limited by any of the details of the description therein but includes all the embodiments which fall within the scope of the appended claims.

What is claimed is:

1. A keyboard device comprising:

a plurality of keys; and action mechanisms respectively provided corresponding to the plurality of keys, wherein each of the action mechanisms includes a transmission member which is configured to be displaced in response to a depression operation on a corresponding key of the plurality of keys, a transmission holding shaft which holds the transmission member, and a hammer member which provides an action load to the corresponding key subjected to the depression operation by being displaced in a direction in response to the displacement of the transmission member corresponding to the key subjected to the depression operation, wherein the transmission member includes a transmission body section, a transmission fitting section formed at one end of the transmission body section and mounted on the transmission holding shaft, and a member which aides in establishing a barycenter position, formed on the transmission body section, wherein a plurality of ribs are formed on the transmission body section, the plurality of ribs forming a lattice shape having a plurality of cells, and wherein the member which aides in establishing a barycenter position comprises ribs which form parts of cells that are finer than a cell adjacent thereto in the lattice shape.

2. The keyboard device according to claim 1, wherein the member which aides in establishing a barycenter position establishes a barycenter position of the transmission member so that a distance between the barycenter position of the transmission member and a center position of the transmission fitting section is a predefined value.

3. The keyboard device according to claim 1, wherein the member which aides in establishing a barycenter position comprises fine-grid ribs which are positioned in cells of the lattice shape to divide the cells so as to form the parts of the cells in the lattice shape that are finer than the cell adjacent thereto, and wherein the member which aides in establishing a barycenter position is positioned at a position of the transmission body section having a different distance from the transmission fitting section than a distance from a center of the transmission body section.

4. The keyboard device according to claim 3, wherein the fine-grid ribs are provided in two cells positioned on a lower side of the center on the transmission body section and in a cell positioned at a distance from the transmission fitting section longer than a distance from the center.

5. The keyboard device according to claim 3, wherein ribs formed on an upper side of the transmission body section are in a lattice shape finer than a lattice shape of ribs on a lower side of the transmission body section.

6. The keyboard device according to claim 1, wherein the transmission member has a vertical plate section and the ribs formed in the lattice shape on the vertical plate section.

7. The keyboard device according to claim 1, wherein the transmission member is constituted by the ribs formed in the lattice shape.

8. A keyboard instrument comprising:

the keyboard device according to claim 1; and a sound source section which emits a musical sound in response to an operation on a key of the keyboard device.

* * * * *